US008757852B2

(12) United States Patent
Lopez et al.

(10) Patent No.: US 8,757,852 B2
(45) Date of Patent: Jun. 24, 2014

(54) LIGHTING APPARATUS

(75) Inventors: Peter E. Lopez, Cary, NC (US); Aparna Sproelich, Cary, NC (US); Jason Taylor, Cary, NC (US)

(73) Assignee: Cree, Inc., Durham, NC (US)

( * ) Notice: Subject to any disclaimer, the term of this patent is extended or adjusted under 35 U.S.C. 154(b) by 425 days.

(21) Appl. No.: 13/084,174

(22) Filed: Apr. 11, 2011

(65) Prior Publication Data

US 2012/0106176 A1 May 3, 2012

Related U.S. Application Data

(60) Provisional application No. 61/407,418, filed on Oct. 27, 2010.

(51) Int. Cl.
*F21V 29/00* (2006.01)

(52) U.S. Cl.
CPC ..... *F21V 29/002* (2013.01)
USPC ..... 362/382; 362/294

(58) Field of Classification Search
CPC ..... F21V 29/002
USPC ..... 362/6, 547, 294, 373, 382
See application file for complete search history.

(56) References Cited

U.S. PATENT DOCUMENTS

| | | | | |
|---|---|---|---|---|
| 6,851,467 | B1 | 2/2005 | Bamford et al. | |
| 7,303,301 | B2 | 12/2007 | Koren et al. | |
| D578,698 | S | 10/2008 | Zheng | |
| 7,458,706 | B1 * | 12/2008 | Liu et al. | 362/373 |
| D591,894 | S | 5/2009 | Flank | |
| 7,553,047 | B2 | 6/2009 | Shin et al. | |
| D611,650 | S | 3/2010 | Broekhoff | |
| 7,744,259 | B2 | 6/2010 | Walczak et al. | |
| D627,727 | S * | 11/2010 | Alexander et al. | D13/134 |
| D627,912 | S * | 11/2010 | Mo | D26/72 |
| D628,156 | S | 11/2010 | Alexander et al. | |
| 7,845,393 | B2 | 12/2010 | Kao et al. | |
| D633,099 | S | 2/2011 | Van de Ven et al. | |
| 7,914,902 | B2 | 3/2011 | Kao et al. | |
| 7,967,474 | B2 | 6/2011 | Ghim et al. | |
| D651,735 | S | 1/2012 | Dai | |
| 8,125,776 | B2 | 2/2012 | Alexander et al. | |
| D656,263 | S | 3/2012 | Ogawa et al. | |
| D663,466 | S | 7/2012 | Rashidi | |
| D664,291 | S | 7/2012 | Blincoe et al. | |
| D666,351 | S | 8/2012 | Tsao | |
| D667,155 | S | 9/2012 | Rashidi | |

(Continued)

FOREIGN PATENT DOCUMENTS

| | | | |
|---|---|---|---|
| WO | 2009111940 | A1 | 9/2009 |
| WO | 2011037879 | A1 | 3/2011 |

OTHER PUBLICATIONS

International Search Report and Written Opinion for PCT/US2011/055881 mailed Jun. 14, 2012, 24 pages.

(Continued)

*Primary Examiner* — David V Bruce

(74) *Attorney, Agent, or Firm* — Withrow & Terranova, P.L.L.C.

(57) ABSTRACT

The present disclosure relates to a lighting apparatus that includes a light engine that is coupled to a heat sink. The light engine provides a light source that generates light, and heat that is generated by the light source is dissipated, at least in part, via the heat sink.

50 Claims, 21 Drawing Sheets

(56) References Cited

U.S. PATENT DOCUMENTS

| | | | | |
|---|---|---|---|---|
| 8,292,482 | B2 | 10/2012 | Harbers et al. | |
| D672,905 | S | 12/2012 | Kong | |
| 8,322,892 | B2 | 12/2012 | Scordino et al. | |
| D679,044 | S | 3/2013 | Jeswani et al. | |
| 8,403,533 | B1 | 3/2013 | Paulsel | |
| D683,063 | S | 5/2013 | Lopez et al. | |
| D683,882 | S | 6/2013 | Rashidi | |
| D683,890 | S | 6/2013 | Lopez et al. | |
| D691,760 | S | 10/2013 | Lopez et al. | |
| 8,545,064 | B2 | 10/2013 | Blincoe et al. | |
| D696,448 | S | 12/2013 | Huh | |
| 2006/0196636 | A1 | 9/2006 | Liu | |
| 2006/0290891 | A1 | 12/2006 | Wang et al. | |
| 2007/0253202 | A1 | 11/2007 | Wu et al. | |
| 2007/0297177 | A1 | 12/2007 | Wang et al. | |
| 2009/0034283 | A1 | 2/2009 | Albright et al. | |
| 2009/0147517 | A1 | 6/2009 | Li et al. | |
| 2009/0201683 | A1 | 8/2009 | Chuan | |
| 2009/0290343 | A1* | 11/2009 | Brown et al. | 362/235 |
| 2010/0039829 | A1 | 2/2010 | Tsai | |
| 2010/0225220 | A1 | 9/2010 | Tanaka et al. | |
| 2010/0259935 | A1 | 10/2010 | Scordino et al. | |
| 2010/0315812 | A1 | 12/2010 | Liu | |
| 2011/0002124 | A1 | 1/2011 | Chang et al. | |
| 2011/0074289 | A1 | 3/2011 | Van De Ven et al. | |
| 2011/0075411 | A1 | 3/2011 | Van De Ven et al. | |
| 2011/0075414 | A1 | 3/2011 | Van De Ven et al. | |

OTHER PUBLICATIONS

Restriction Requirement for U.S. Appl. No. 29/377,926, mailed Sep. 11, 2012, 7 pages.

Invitation to Pay Additional Fees for PCT/2011/055881 mailed Feb. 27, 2012, 7 pages.

International Preliminary Report on Patentability for PCT/US2011/055881 mailed Jan. 23, 2013, 8 pages.

Written Opinion of the International Preliminary Examining Authority for PCT/US2011/055881 mailed Oct. 19, 2012, 8 pages.

Notice of Allowance for U.S. Appl. No. 29/450,912, mailed Sep. 26, 2013, 8 pages.

Notice of Allowance for U.S. Appl. No. 29/476,939, mailed Mar. 21, 2014, 7 pages.

* cited by examiner

LIGHTING APPARATUS

RELATED APPLICATIONS

This application claims the benefit of U.S. provisional patent application No. 61/407,418, filed Oct. 27, 2010, the disclosure of which is incorporated herein by reference in its entirety.

FIELD OF THE DISCLOSURE

The present disclosure relates to lighting apparatus.

BACKGROUND

In recent years, a movement has gained traction to replace incandescent light bulbs with lighting fixtures that employ more efficient lighting technologies. One such technology that shows tremendous promise employs light emitting diodes (LEDs). Compared with incandescent bulbs, LED-based light fixtures are much more efficient at converting electrical energy into light and are longer lasting, and as a result, lighting fixtures that employ LED technologies are expected to replace incandescent bulbs in residential, commercial, and industrial applications.

Unlike incandescent bulbs that operate by subjecting a filament to a desired current, LED-based lighting fixtures require control electronics to drive one or more LEDs. The control electronics includes a power supply and circuitry to provide the pulse streams or other signals that are required to drive the one or more LEDs in a desired fashion. While much more efficient than incandescent bulbs, the control electronics and the LEDs of the lighting fixture will emit a certain amount of heat, which should be efficiently dissipated to avoid damaging or reducing the operating life of the control electronics or the LEDs.

Since the control electronics and the LEDs of an LED-based lighting fixture are often mounted in such a way to allow the LED-based lighting fixture to replace either an incandescent light bulb or a lighting fixture that is compatible with an incandescent bulb, the control electronics and LEDs are often mounted in a location that is not conducive for heat dissipation. As such, there is a need to efficiently and effectively dissipate heat that is generated by the control electronics, the LEDs, or a combination thereof in LED-based lighting fixtures as well as other types of lighting fixtures that are faced with similar heat dissipation needs.

SUMMARY

The present disclosure relates to a lighting apparatus that includes a light engine that is coupled to a heat sink. The light engine provides a light source that generates light, and heat that is generated by the light source is dissipated, at least in part, via the heat sink.

In a first embodiment, the heat sink has a forward surface and a central axis that is substantially perpendicular to the forward surface. The heat sink also has a plurality of radial fins that extend radially outward from the central axis. Of these radial fins, a plurality of shorter radial fins are grouped to form different shorter fins sections and a plurality of longer radial fins are grouped to form a plurality of longer fins sections. The shorter and longer fins sections alternate with one another about the central axis of the heat sink. In effect, the shorter radial fins sections provide recessed portions about the outermost periphery of the heat sink that is defined by the longer fins sections. In select embodiments, the heat sink may have a core from which the radial fins extend, and the core may be solid or may have an internal opening.

In another embodiment, a light engine may include a retention ring that is mounted above the forward surface of the heat sink. The retention ring may be by used to hold lenses, diffusers, and the like in place over a mixing chamber, support cup, or the like. The retention ring may include a flange that is substantially parallel to the forward surface of the heat sink and a peripheral sidewall that extends from the flange toward the forward surface of the heat sink. In select embodiments, the peripheral sidewall terminates with an undulating edge. The undulating edge may effectively form alternating teeth and openings, wherein the openings provide greater airflow to the heat sink, and in particular, to those portions of the radial fins that are closer to the center of the heat sink. The added airflow increases performance of the heat sink and the lighting apparatus in general.

Those skilled in the art will appreciate the scope of the disclosure and realize additional aspects thereof after reading the following detailed description in association with the accompanying drawings.

BRIEF DESCRIPTION OF THE DRAWINGS

The accompanying drawings incorporated in and forming a part of this specification illustrate several aspects of the disclosure, and together with the description serve to explain the principles of the disclosure.

DETAILED DESCRIPTION

The embodiments set forth below represent the necessary information to enable those skilled in the art to practice the disclosure and illustrate the best mode of practicing the disclosure. Upon reading the following description in light of the accompanying drawings, those skilled in the art will understand the concepts of the disclosure and will recognize applications of these concepts not particularly addressed herein. It should be understood that these concepts and applications fall within the scope of the disclosure and the accompanying claims.

It will be understood that relative terms such as "front," "forward," "rear," "below," "above," "upper," "lower," "horizontal," or "vertical" may be used herein to describe a relationship of one element, layer or region to another element, layer or region as illustrated in the figures. It will be understood that these terms are intended to encompass different orientations of the device in addition to the orientation depicted in the figures.

Figure 1:
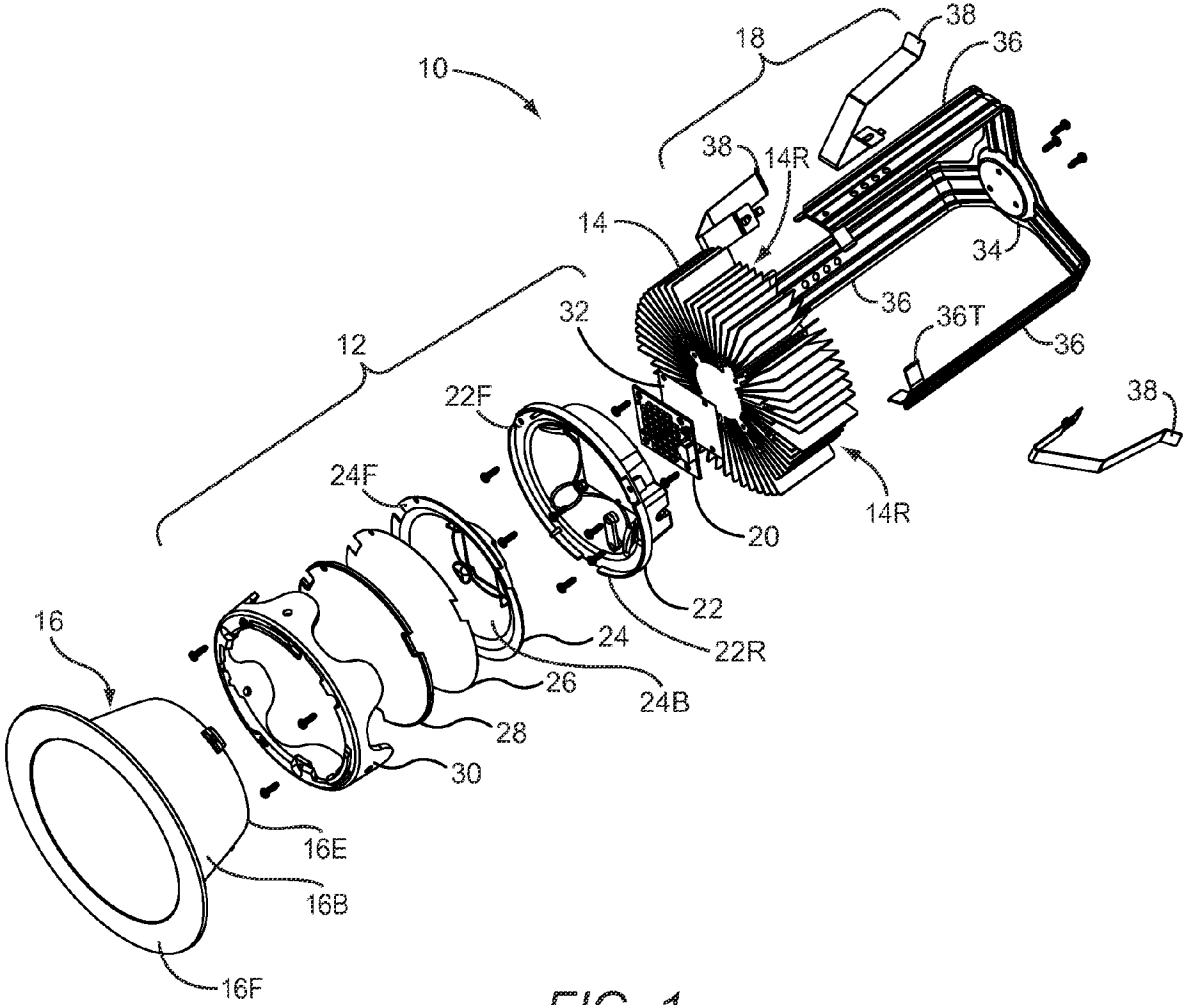
FIG. 1 is an exploded isometric view of a lighting fixture according to one embodiment of the disclosure.
Figure 2:
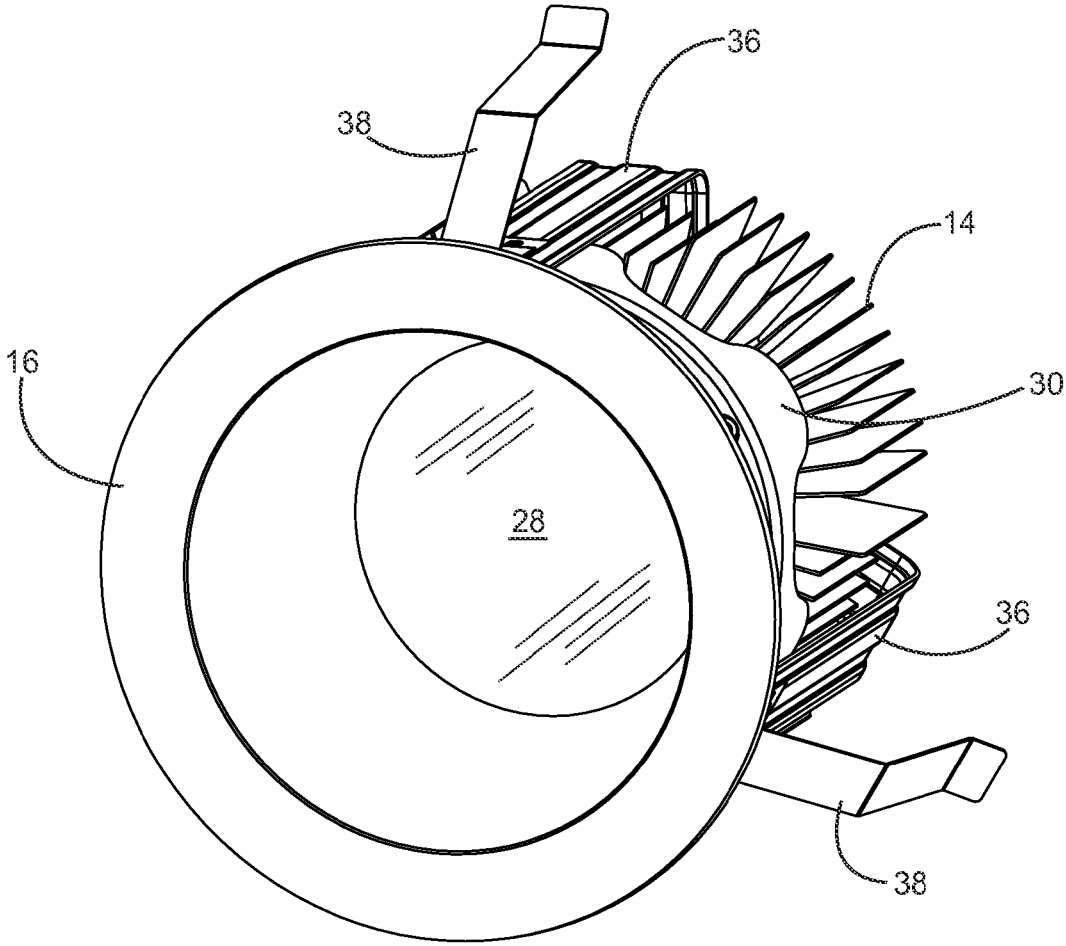
FIG. 2 is an isometric view of the front of the lighting fixture of FIG. 1.
Figure 3:
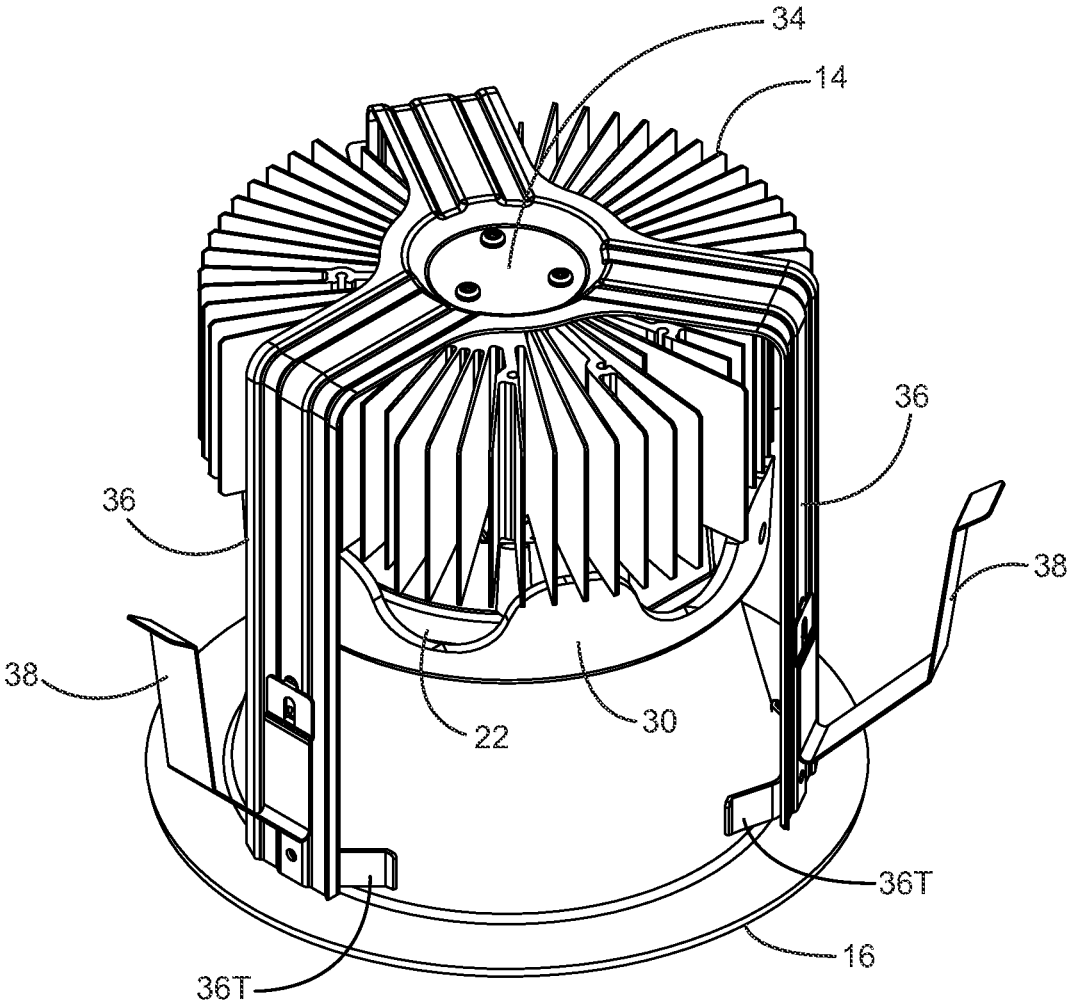
FIG. 3 is an isometric view of the back of the lighting fixture of FIG. 1.

With reference to FIGS. 1, 2, and 3, an exemplary lighting fixture 10 is described according to one embodiment of the disclosure. In particular, FIG. 1 is an exploded front isometric view of the lighting fixture 10, while FIGS. 2 and 3 are front and rear isometric views, respectively, of the assembled lighting fixture 10. The lighting fixture 10 may be divided into four main sections: a light engine 12, a heat sink 14, finishing trim 16, and a support bracket assembly 18. The light engine 12 includes a light source 20 along with a housing assembly, which includes a support cup 22, a mixing chamber 24 having a reflective interior surface, a diffuser 26, a lens 28, and a retention ring 30. In this embodiment, the light source 20 is mounted to the heat sink 14 wherein a thermal pad 32 is used to thermally couple the light source 20 to the heat sink 14. The thermal pad 32 may be formed from any thermally conductive material, such as metal or thermally conductive resins. As illustrated, bolts are used to attach the light source 20 and the thermal pad 32 to a forward surface of the heat sink 14. Notably, the light source 20 is illustrated as a printed circuit board (PCB) having an array of light emitting diodes (LEDs) along with all or a portion of the circuitry necessary to drive the LEDs in a manner to generate visible light. Although not illustrated, a remote module may be used to provide power as well as all or a portion of the circuitry necessary to drive the LEDs. While the light source 20 is illustrated as employing LEDs to generate light, other light generating technologies, such as incandescent, florescent, halogen, and the like are applicable.

The support cup 22 is a primary framing component for the light engine 12. The support cup 22 has a bottom rim, which forms a rear opening and mounts to the heat sink 14 with bolts, such that at least the array of LEDs of the light source 20 remains exposed though the rear opening. In the illustrated embodiment, the rear opening of the support cup 22 is sized and shaped to correspond to and receive the PCB of the light source 20. The support cup 22 also has a forward opening, which is formed by a forward flange 22F and receives the mixing chamber 24. The mixing chamber 24 may take various forms. In the illustrated embodiment, the mixing chamber 24 has a conical or parabolic body 24B with a rear opening that is sized and shaped such that the array of LEDs of the light source 20 remains exposed. The mixing chamber 24 also has a forward opening formed by a forward flange 24F. The mixing chamber 24 concentrically resides inside the support cup 22 wherein the rear surface of the forward flange 24F of the mixing chamber rests on the forward surface of the support cup's forward flange 22F.

A planar diffuser 26, which generally corresponds in shape and size to the outside periphery of the forward flange 24F of the mixing chamber 24, may be placed on the forward surface of the forward flange 24F of the mixing chamber 24, and thus cover the forward opening of the mixing chamber 24. The degree and type of diffusion provided by the diffuser 26 may vary from one embodiment to another. Further, color, translucency, or opaqueness of the diffuser 26 may vary from one embodiment to another. Diffusers 26 are typically formed from a polymer or glass, but other materials are viable. Similarly, a planar lens 28, which generally corresponds to the shape and size of the diffuser 26 as well as the outside periphery of the forward flange 24F of the mixing chamber 24, may be placed over the diffuser 26. As with the diffuser 26, the material, color, translucency, or opaqueness of the lens 28 may vary from one embodiment to another. Further, both the diffuser 26 and the lens 28 may be formed from one or more materials or one or more layers of the same or different materials. While only one diffuser 26 and one lens 28 are depicted, the lighting fixture 10 may have multiple diffusers 26 or lenses 28; no diffuser 26, no lens 28, no diffuser 26 or lens 28, or an integrated diffuser and lens (not shown) in place of the illustrated diffuser 26 and lens 28.

In the illustrated embodiment, a peripheral rim 22R is provided along the outer periphery of the support cup's forward flange 22F. The peripheral rim 22R effectively receives the mixing chamber's forward flange 24F, the diffuser 26, and the lens 28. The retention ring 30 mounts to the support cup's forward flange 22F and functions to hold the mixing chamber 24, diffuser 26, and lens 28 in place. In operation, light emitted from the array of LEDs of the light source 20 is mixed inside the mixing chamber 24 and directed out through the lens 28 in a forward direction to form a light beam. For LED-based applications, the array of LEDs of the light source 20 may include LEDs that emit different colors of light. For example, the array of LEDs may include both red LEDs that emit red light and blue-shifted green LEDs that emit bluish-green light, wherein the red and bluish-green light is mixed to form "white" light at a desired color temperature. For a uniformly colored light beam, relatively thorough mixing of the light emitted from the array of LEDs is desired. Both the mixing chamber 24 and the diffuser 26 play a role in mixing the light emanated from the array of LEDs of the light source 20.

Certain light rays, which are referred to as non-reflected light rays, emanate from the array of LEDs and exit the mixing chamber 24 through the diffuser 26 and lens 28 without being reflected off of the interior surface of the mixing chamber 24. Other light rays, which are referred to as reflected light rays, emanate from the array of LEDs of the light source 20 and are reflected off of the reflective interior surface of the mixing chamber 24 one or more times before exiting the mixing chamber 24 through the diffuser 26 and lens 28. With these reflections, the reflected light rays are effectively mixed with each other and at least some of the non-reflected light rays within the mixing chamber 24 before exiting the mixing chamber 24 through the diffuser 26 and the lens 28. The diffuser 26 functions to diffuse, and as result mix, the non-reflected and reflected light rays as they exit the mixing chamber 24, wherein the mixing chamber 24 and the diffuser 26 provide sufficient mixing of the light emanated from the array of LEDs of the light source 20 to provide a light beam of a consistent color. In addition to mixing light rays, the diffuser 26 is designed and the mixing chamber 24 shaped in a manner to control the relative concentration and shape of the resulting light beam that is projected from the diffuser 26 and the lens 28. For example, a first lighting fixture 10 may be designed to provide a concentrated beam for a spotlight, wherein another may be designed to provide a widely dispersed beam for a floodlight. Notably, the finishing trim 16 may also be designed to further contribute to light mixing, beam shaping, or both, when attached to the retention ring 30, as illustrated in FIGS. 2 and 3. The interior surface of the finishing trim 16 may range from a highly reflective metal coating to a matte black finish, depending on the desired aesthetics and functionality.

In particular, the finishing trim 16 generally provides a conical body 16B extending between a forward flange 16F and a rear edge 16E. When the finishing trim 16 is attached to the retention ring 30, the rear edge 16E of the finishing trim 16 is held against a forward surface of the retention ring 30. An exemplary mechanism for attaching the finishing trim 16 to the retention ring 30 is provide further below; however, numerous techniques are available to those skilled in the art for attaching the finishing trim 16 to the retention ring 30.

In select embodiments, the support bracket assembly 18 is employed to facilitate mounting the lighting fixture 10 in a cavity that is formed in ceiling, wall, cabinet, or the like. The illustrated support bracket assembly 18 comprises a support bracket core 34 and multiple support bracket legs 36, which extend from the support bracket core 34. As illustrated, the support bracket legs 36 are spaced 120° apart from one another and initially extend radially from the support bracket core 34 along a rear surface of the heat sink 14. Once the support bracket legs 36 reach the outside edge of the heat sink 14, the support bracket legs 36 bend approximately 90° and extend along the side of the heat sink 14, the light engine 12, and the finishing trim 16. In select embodiments and as described in further detail below, the side(s) of the heat sink 14 may be formed to have recessed portions 14R that extend from the forward surface of the heat sink 14 to the rear surface of the heat sink 14. The respective support bracket legs 36 may lie in and along the recessed portions 14R of the heat sink 14, such that the overall lateral dimensions of the support bracket assembly 18 does not need to be larger, or if it is larger, only nominally larger, than the overall lateral dimensions of the heat sink 14. For example, if the heat sink 14 is substantially cylindrical and has an overall radius of x, the effective radius of the support bracket assembly 18 is either x, less than x, or within about 10% of x.

Further, support tabs 36T may be provided at or near the ends of the support bracket legs 36. In the illustrated embodiment, the support tabs 36T are substantially V-shaped and designed to rest against the outside surface of the body 16B of the finishing trim 16. Support clips 38 may also be attached to the support bracket legs 36. The support clips 38 may be used to hold the lighting fixture 10 in a cavity in which the lighting fixture 10 is to be mounted. For mounting, the support clips 38 are sprung radially inward, the lighting fixture 10 is placed rear-side first through an opening into the cavity, and once in place, the support clips 38 are allowed to spring radially outward and press against the inside walls or ledges within the cavity. The cavity is formed and the support clips 38 are designed such that the lighting fixture may be held securely in the cavity by the support clips 38. Those skilled in the art will recognize additional or alternative techniques for mounting or maintaining the lighting fixture 10 in a cavity or other desired location. While recessed mounting hardware is illustrated, the lighting fixture 10 may be recess, track, surface, or pole mounted using any available mounting techniques.

Figure 4:
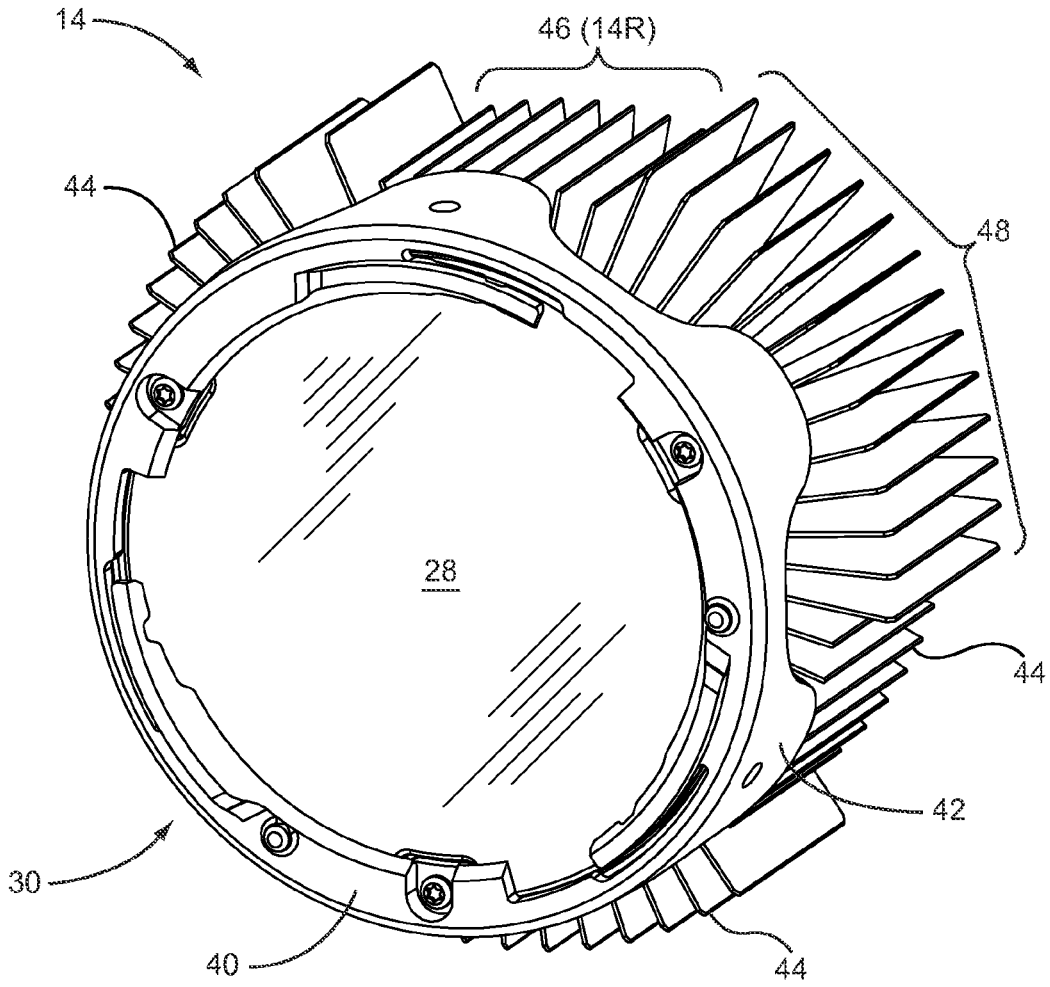
FIG. 4 is a first isometric view of the front of the lighting fixture of FIG. 1 without the finishing trim and support bracket.
Figure 5:
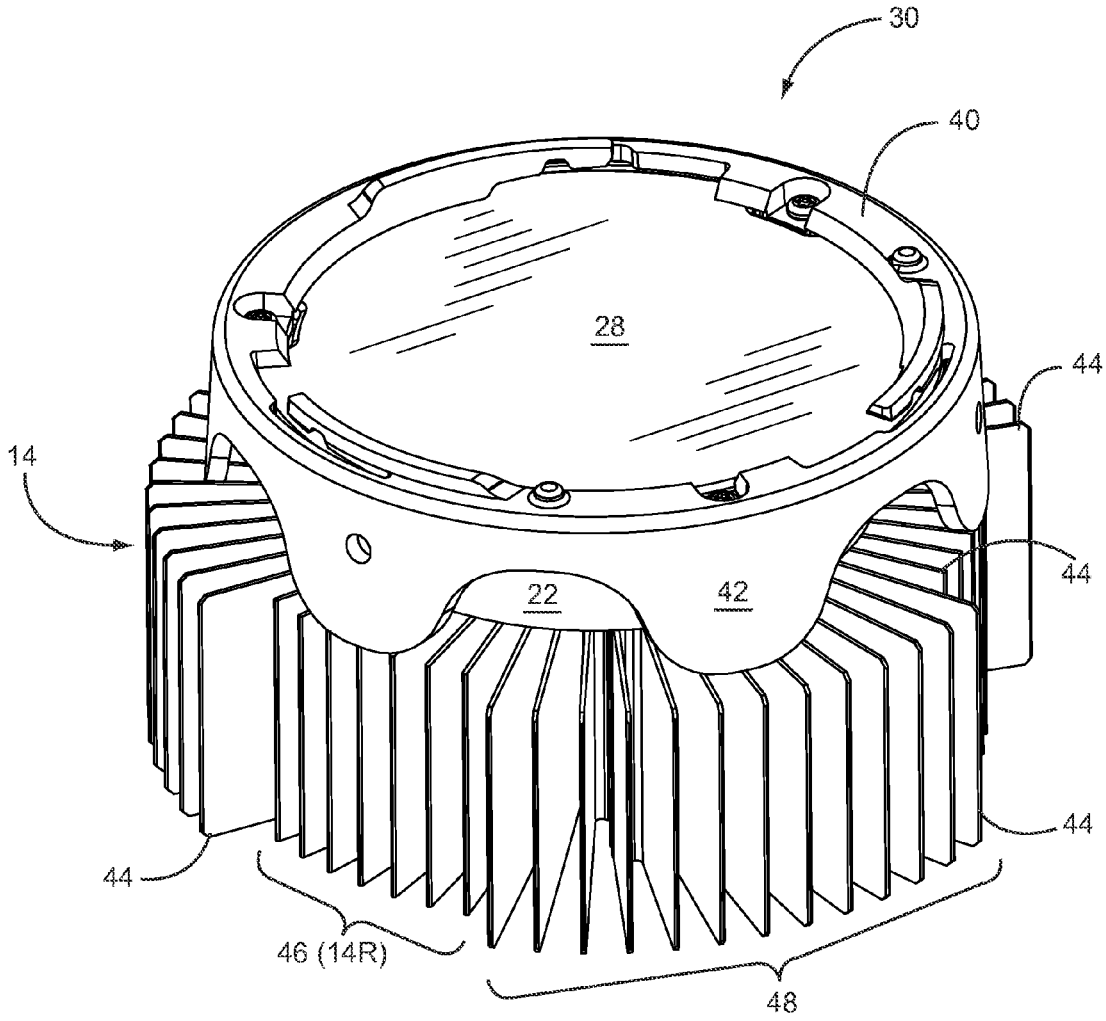
FIG. 5 is a second isometric view of the front of the lighting fixture of FIG. 1 without the finishing trim and support bracket.

FIGS. 4 and 5 provide different isometric views of the front side of the lighting fixture 10 without the finishing trim 16 and support bracket assembly 18, according to one embodiment of the disclosure. Primarily visible in FIGS. 4 and 5 are the retention ring 30 and the heat sink 14, which are designed to efficiently and effectively dissipate heat that is generated from the light source 20 during operation, as well as provide an appealing aesthetic quality. As noted above, the light source 20 is thermally coupled to the heat sink 14 via the thermal pad 32. Heat generated by the light source 20 is efficiently transferred to the heat sink 14 and dissipated. The retention ring 30 is designed to provide enhanced airflow to the heat sink 14, and thus, aid in the ability of the heat sink 14 to dissipate the heat generated by the light source 20. Details of the retention ring 30 and the heat sink 14 are provided below.

As illustrated in FIGS. 4 and 5, the retention ring 30 has an annular flange 40 and a peripheral side wall 42, which is substantially perpendicular to the annular flange 40. In the illustrated embodiment, the retention ring 30 is attached to the support cup 22 via the annular flange 40 using one or more bolts. The peripheral side wall 42 extends from the rear of the annular flange 40 and along the outer periphery of the support cup 22. Notably, the peripheral side wall 42 terminates with an undulating edge opposite the rear of the annular flange 40. The peripheral side wall 42 covers and protects a portion of the support cup 22 while providing periodic openings to allow greater airflow to the heat sink 14. The undulating edge of the peripheral side wall 42 is shown as having a sinusoidal contour, or profile, with a fixed period; however, the undulating edge may take on different contours, such as contours that correspond to square, sawtooth, or triangular wave functions. Also, the period for the undulating edge may vary, and thus need not have a fixed period. As such, the peripheral side wall 42 may be characterized as having a plurality of spaced apart teeth that extend from the rear of the annular flange 40 toward or substantially to the heat sink 14, thereby providing spaces, or openings, between the teeth. Through these spaces, or openings, greater air flow is made available to a larger portion of the heat sink 14. In particular, greater air flow is provided toward the center of the heat sink 14.

The heat sink 14 includes radial fins 44 that are substantially parallel to the central axis of the substantially cylindrical heat sink 14. In the illustrated embodiment, each of three shorter fin sections 46 has a group of adjacent radial fins 44, which radially extend to a first distance relative to the central axis of the heat sink 14. The three shorter fins sections 46 are separated by a longer fins section 48, such that the shorter and longer fins sections 46, 48 alternate with one another about the outer periphery of the heat sink 14. As illustrated, there are also three longer fins sections 48; however, the number of shorter and longer fins sections 46, 48 may vary from one embodiment to the next. Each of three longer fin sections 48 has a group of adjacent radial fins 44, which radially extend to a second distance relative to the central axis of the heat sink 14, wherein the second distance is greater than the first distance. Relative to the longer fins sections 48, the shorter fins sections 46 effectively form the recessed portions 14R, which are clearly visible in FIGS. 4, 5, and 6. While only longer and shorter fins sections 48, 46 are illustrated, one or more intermediate fins sections (not illustrated) may be provided wherein the intermediate fins sections (not shown) have a group of adjacent radial fins 44, which radially extend to a third distance relative to the central axis of the heat sink 14, wherein the third distance is between the first and second distances.

As noted above and illustrated in FIGS. 2 and 3, the recessed portions 14R of the heat sink 14 provide channels in which the respective support bracket legs 36 of the support bracket assembly 18 may lie. Generally, the support bracket legs 36 are spaced apart from the outer surfaces of the radial fins 44 in the shorter fins section 46, yet are either substantially aligned with or do not extend substantially past the effective periphery (second distance) formed by the outer surfaces of the radial fins 44 in the longer fins sections 48.

Figure 6:
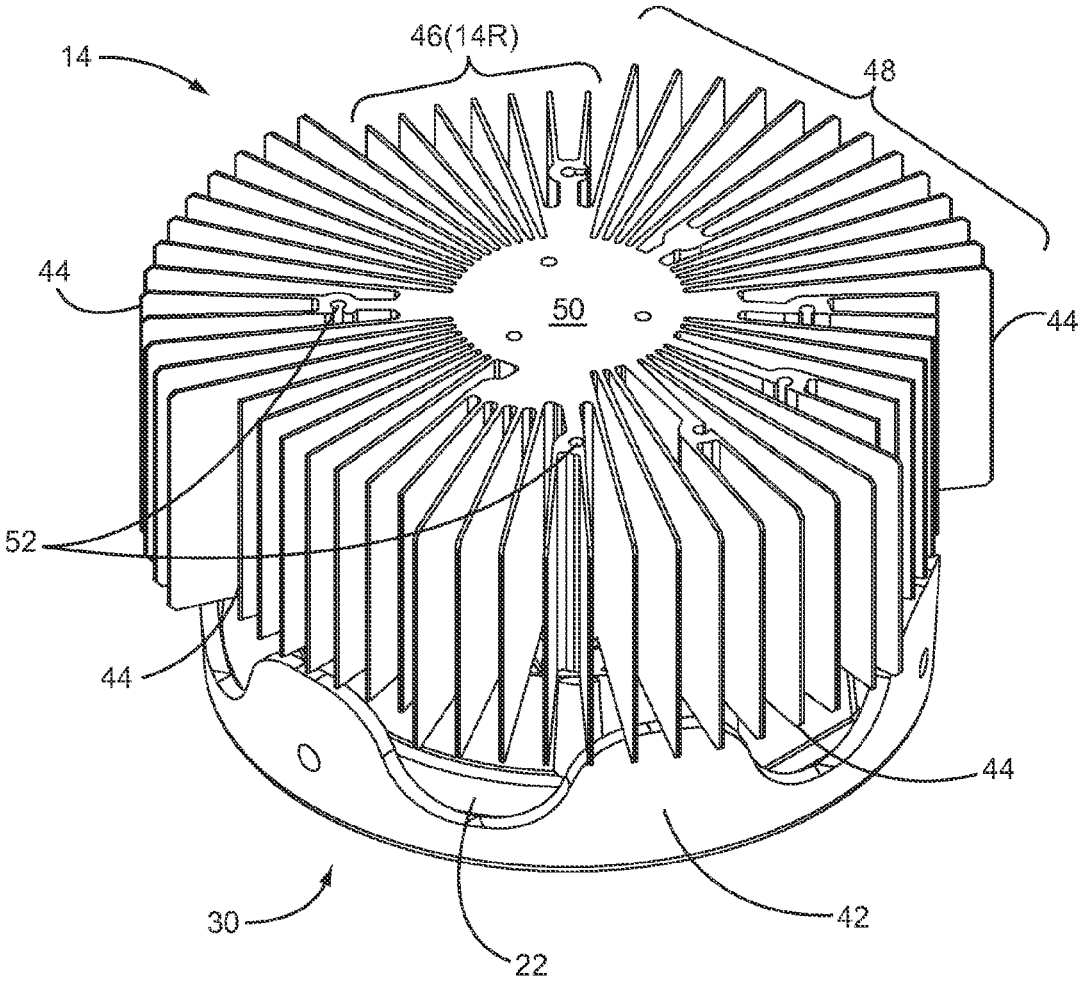
FIG. 6 is an isometric view of the back of the lighting fixture of FIG. 1 without the finishing trim and support bracket.
Figure 7:
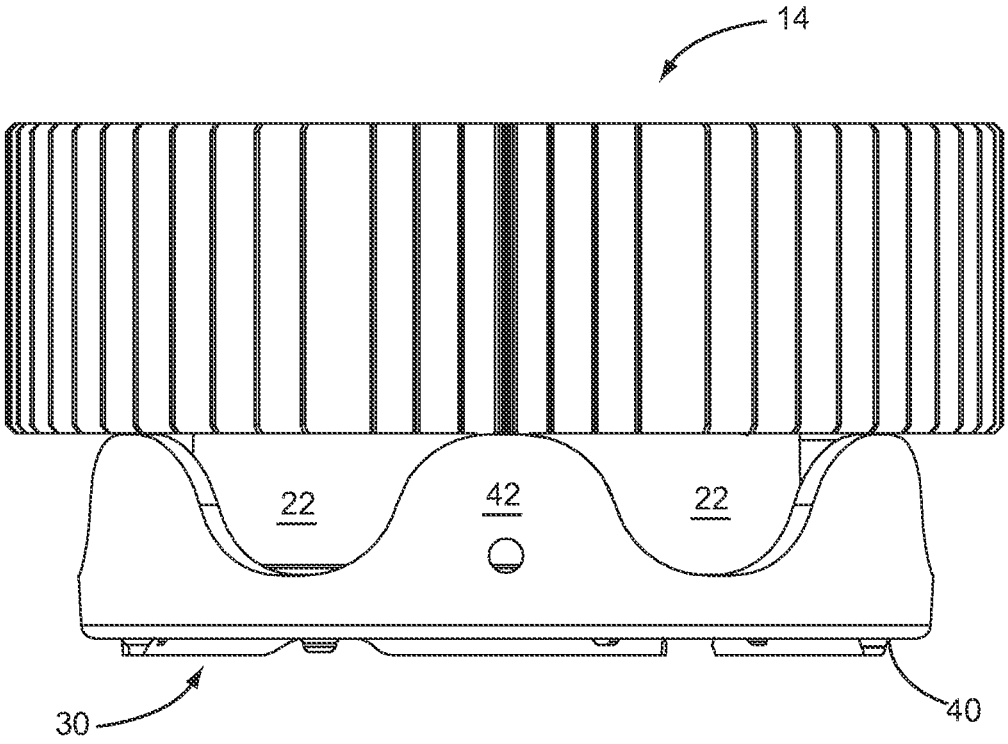
FIG. 7 is a side plan view of the lighting fixture of FIG. 1 without the finishing trim and support bracket.
Figure 8:
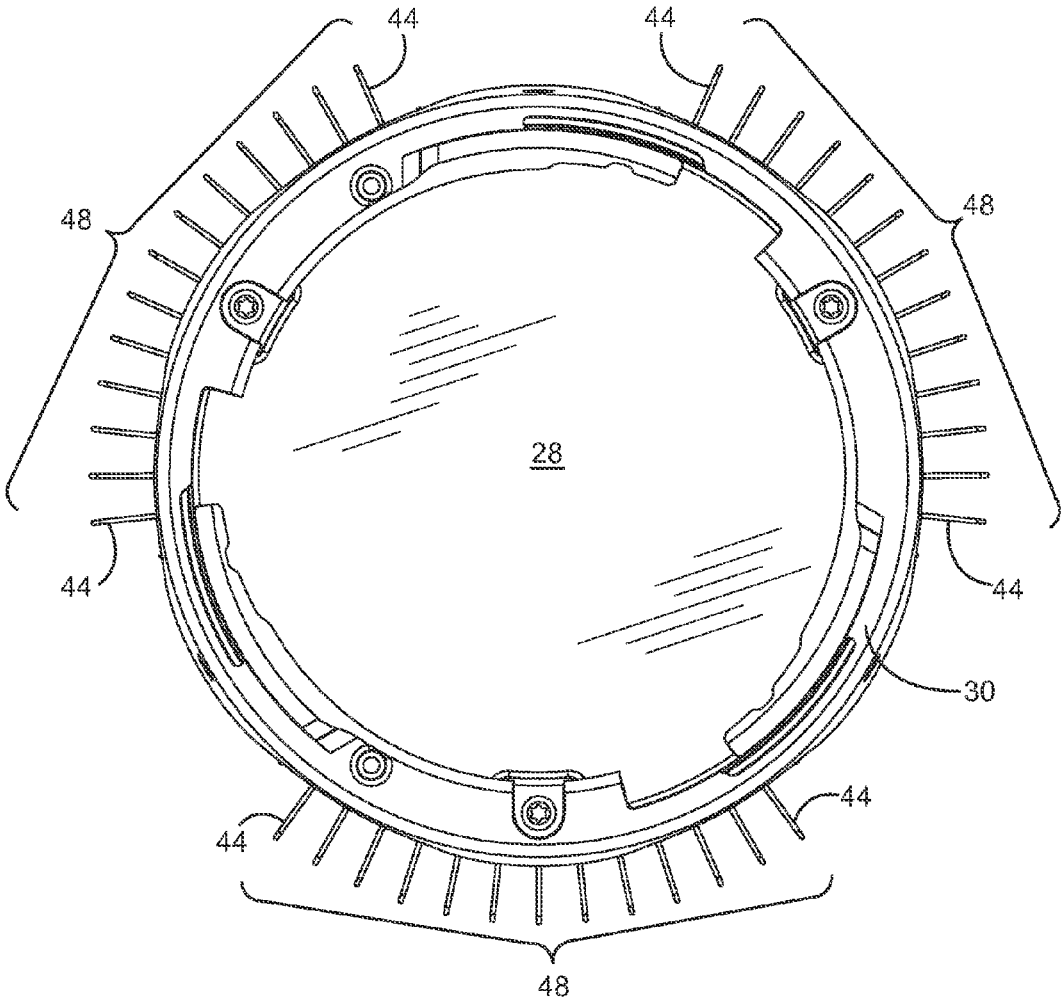
FIG. 8 is a front plan view of the lighting fixture of FIG. 1 without the finishing trim and support bracket.

As illustrated in FIGS. 6, 7, and 8, the radial fins 44 in the longer fins section 48 may extend substantially past the outer periphery of the retention ring 30. The radial fins 44 of the shorter fins section 46 may extend to the outer periphery of the retention ring 30, wherein the outer edges of the radial fins 44 of the shorter fins section 46 are substantially flush with the outer surface of the peripheral side wall 42 of the retention ring. In another embodiment, the radial fins 44 of the shorter fins section 46 may extend to the point substantially within the outer periphery of the retention ring 30, wherein the outer edges of the radial fins 44 of the shorter fins section 46 are not flush with the outer surface of the peripheral side wall 42 of the retention ring 30.

As illustrated in FIGS. 4, 5, 6, and 7, the widest portions of the peripheral side wall 42 of the retention ring 30 may extend to points substantially adjacent the forward surfaces of the radial fins 44 of the heat sink 14. Alternatively, the lowest portions of the peripheral side wall 42 of the retention ring 30 may be spaced substantially away from the forward surfaces of the radial fins 44 of the heat sink 14. Regardless of the widths associated with the peripheral side wall 42, the spaces, or openings, provided by the peripheral side wall 42 allow greater air flow to a larger portion of the heat sink 14. Notably, greater air flow is provided toward the center of the heat sink 14, and in particular along portions of the radial fins 44 that are proximate the core 50.

As illustrated in FIG. 6, the heat sink 14 may include a solid, generally cylindrical core 50, wherein the center axis of the heat sink 14 generally corresponds to the center axis of the core 50. The radial fins 44 effectively extend outward from the outer surface core 50, wherein the cylindrical core 50 and the radial fins 44 form the heat sink 14. In alternate embodiments, the core 50 may be hollow or have one or more openings or cavities therein. Threaded mounting holes 52 may be formed on one or both of the forward and rear surfaces of the heat sink 14 to facilitate attaching elements, such as the support bracket assembly 18, support cup 22, light source 20, and the like. In one embodiment, the entirety of the heat sink 14 is extruded as a single integrated component from highly thermally conductive metal, such as aluminum, copper, gold, or the like.

Figure 9:
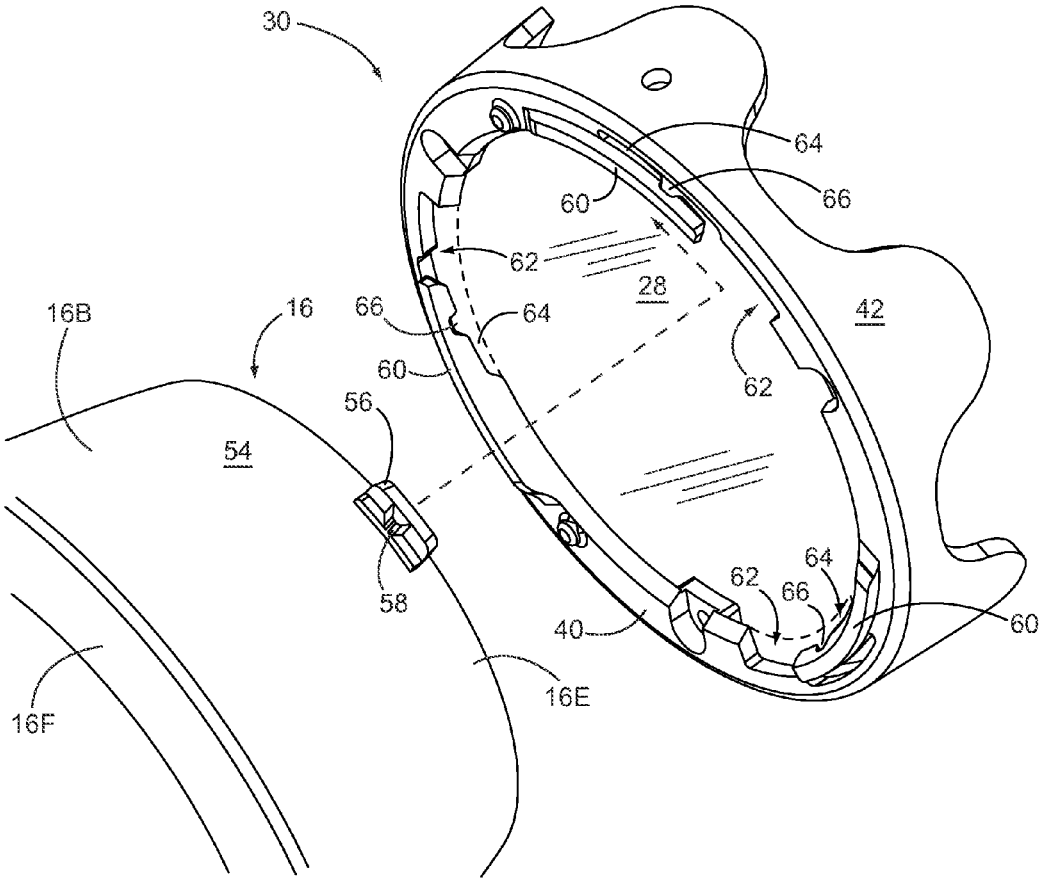
FIG. 9 is an exploded isometric view of the finishing trim and retention ring of the light engine of the lighting fixture of FIG. 1.

With reference to FIG. 9, an enlarged view of the finishing trim 16 and the retention ring 30 is illustrated. In one embodiment of the disclosure, multiple trim ears 56 (only one shown) are provided on an outer surface of the body 16B and at or near the rear edge 16E of the finishing trim 16 and used to securely attach the finishing trim 16 to the retention ring 30. The trim ears 56 extend radially outward from the outer surface of the body 16B and may have a tab 58 formed on the forward or rear surfaces thereof. The forward surface of the retention ring's annular flange 40 has multiple locking members 60 and slots 62. Each locking member is an elongated and deflectable cantilever that resides substantially parallel to the forward surface of the lens 28. A channel 64 is formed between each locking member 60 and the surface of the lens 28 in the illustrated embodiment; however, the channel 64 could be formed entirely within the retention ring's annular flange 40. The slots 62 are provided in the retention ring's annular flange 40 and are in communication with the corresponding channels 64.

The trim ears 56 have a defined length and thickness. The slots 62 are wider than the length of the trim ears 56, and the channels 64 have a thickness approximating that of the trim ears 56. As such, the finishing trim 16 can be aligned and moved along a center axis toward the retention ring 30, such that the trim ears 56 of the finishing trim 16 slide are positioned in the slots 62 of the retention ring 30. Once the trim ears 56 of the finishing trim 16 are in the slots 62 of the retention ring 30, the trim ears 56 will slide into the channel 64 as the finishing trim 16 is rotated in the appropriate direction about the center axis. In the illustrated embodiment, the locking members 60 are configured such that the finishing trim 16 must be rotated counter-clockwise to move the trim ears 56 into the respective channels 64. The channels 64 may be sized to provide a friction fit for the trim ears 56 between the locking members 60 and the lens 28. As such, the locking members 60 may slightly deflect away from the lens 28 as the trim ears 56 enter and move along the respective channels 64, wherein the trim ears 56 are held in place by being pinned between the locking members 60 and the lens 28 (or other surface). The surface of locking members 60 that faces the lens 28 may also have a notch 66 that is complementary to the ear tab 58 of the trim ear 56. The notch 66 is positioned along the channel 64 such that the ear tabs 58 of the trim ears 56 engage the notches 66 when the finishing trim 16 is rotated into place.

Figure 10:
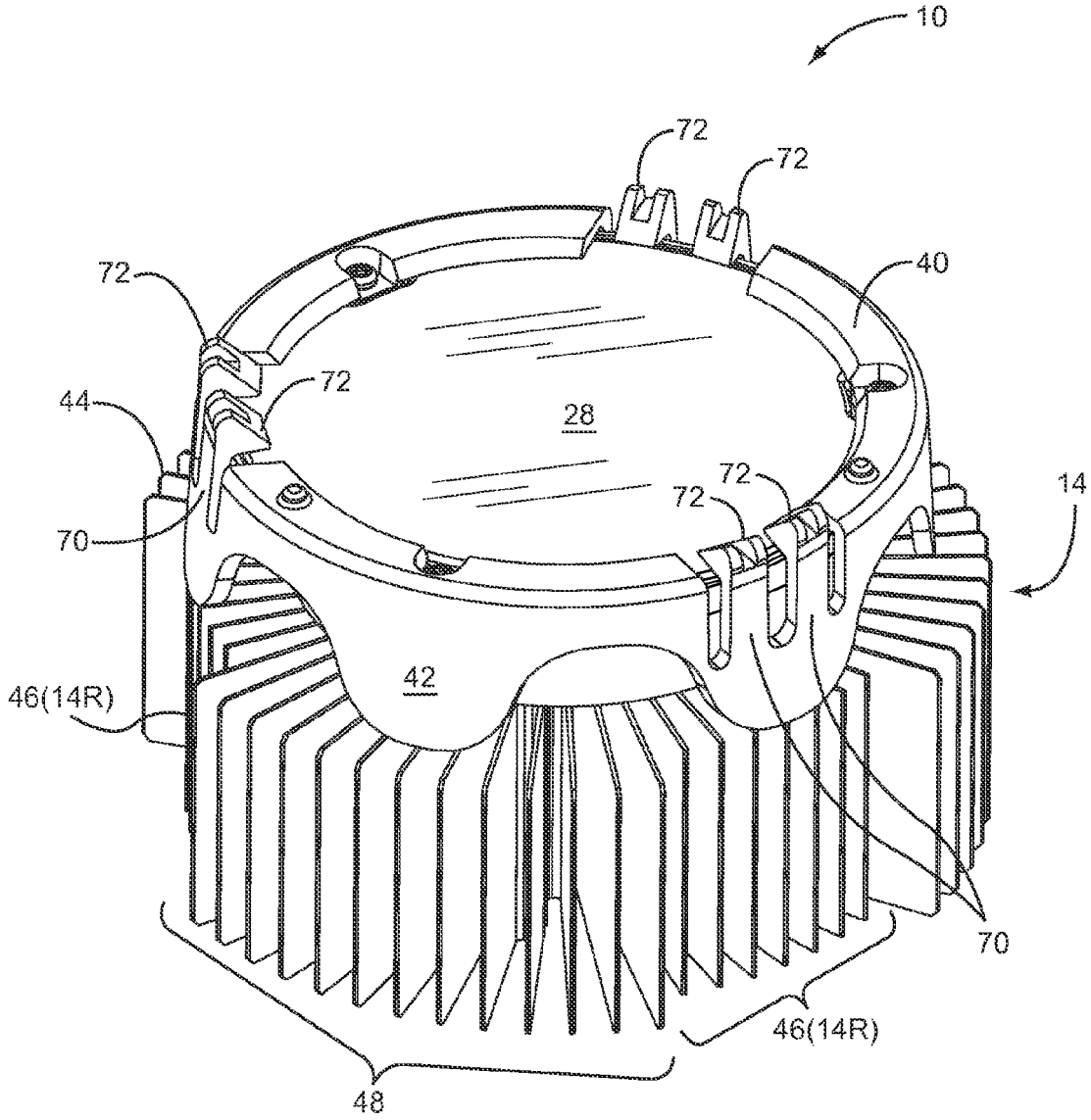
FIG. 10 is an isometric view of the front of a lighting fixture without the finishing trim and support bracket according to an alternative embodiment.
Figure 11:
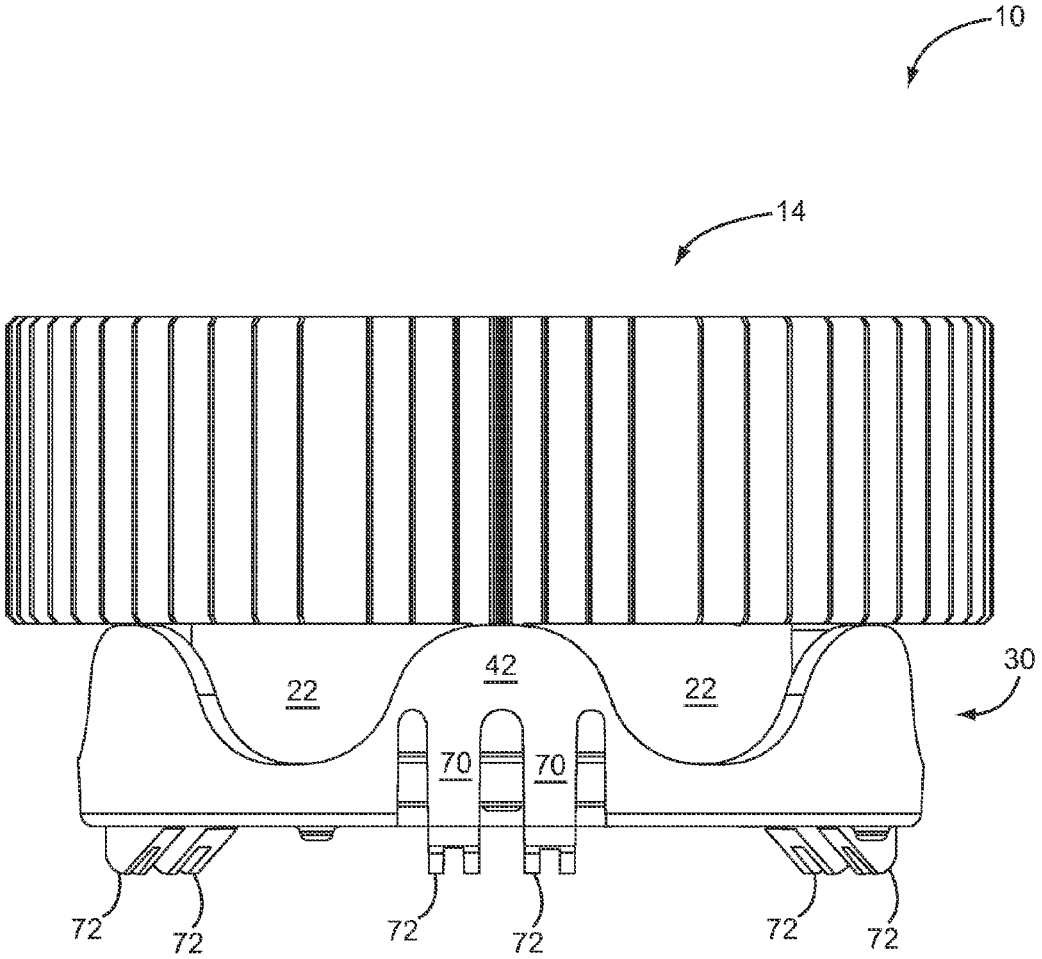
FIG. 11 is a side plan view of the lighting fixture of FIG. 10 without the finishing trim and support bracket.
Figure 12:
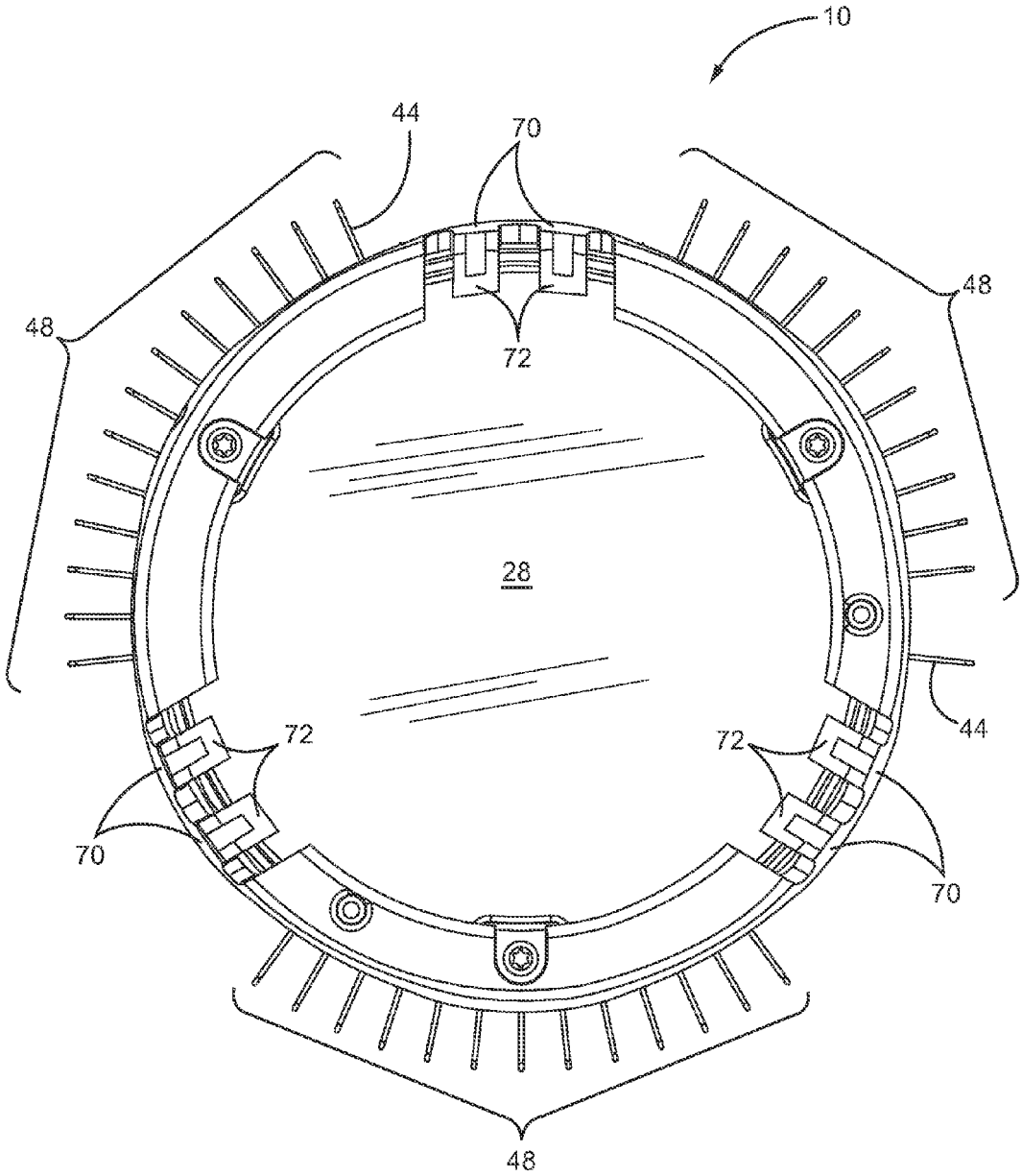
FIG. 12 is a front plan view of the lighting fixture of FIG. 10 without the finishing trim and support bracket.

FIGS. 10, 11, and 12 are isometric, side, and top views of an alternative embodiment of the lighting fixture 10. In this embodiment, the locking members 60 and slots 62 that were on the forward surface of the retention ring's annular flange 40 in the previous embodiment are replaced with elongated fingers 70 that have distal clips 72. Each pair of elongated fingers 70 is formed in one of the teeth of the peripheral side wall 42. The elongated fingers 70 may be integrally formed in the peripheral side wall 42 of the annular flange 40 and generally extend parallel to the central axis of the lighting fixture 10. Each elongated finger 70 extends in the forward direction sufficiently to suspend the distal clips 72 above the lens 28 a distance, which corresponds to the thickness of the trim ears 56 of the finishing trim 16. The distal clips 72 extend radially inward toward the central axis of the lighting fixture 10.

Figure 13:
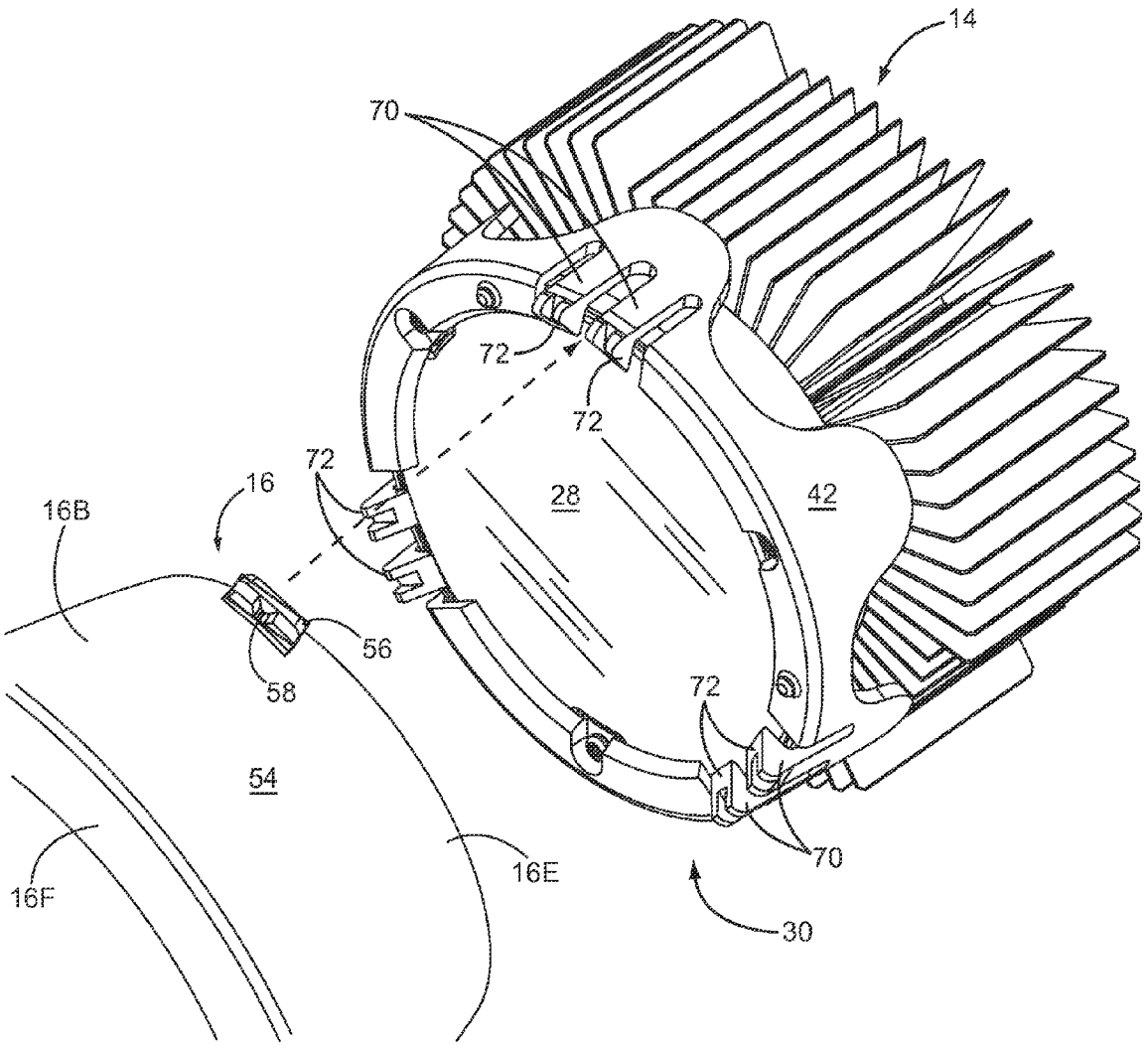
FIG. 13 is an exploded isometric view of the finishing trim and retention ring of the light engine of the lighting fixture of FIG. 10.

As shown in FIG. 13, the finishing trim 16 can be snapped onto the retention ring 30 by first aligning the trim ears 56 with each pair of the elongated fingers 70 and then axially moving the finishing trim 16 toward the retention ring 30. As the finishing trim 16 is moved into place and comes into contact with the distal clips 72 of the elongated fingers 70, the elongated fingers 70 allow the trim ears 56 to spring radially outward. As the finishing trim 16 is moved into its resting position, the distal clips 72 will clear the trim ears 56 and spring radially inward to or near their normal resting position, such that the distal clips 72 rest over the trim ears 56. In this position, the distal clips 72 function to hold the finishing trim 16 in place against the annular flange 40 of the retention ring 30 or the lens 28. As opposed to the prior embodiment, which employed a twisting action to lock the finishing trim 16 into place, the current embodiment allows the finishing trim 16 to be locked into place on the retention ring 30 with a single axial motion.

In FIGS. 10 through 13, pairs of elongated fingers 70 are depicted; however, the elongated fingers 70 may be provided singularly or in groups of three or more. Further, elongated fingers 70 are shown in three different teeth of the peripheral side wall 42. In other embodiments, one or more elongated fingers 70 may be provided on one, two, four, or more teeth of the peripheral side wall 42.

Figure 14:
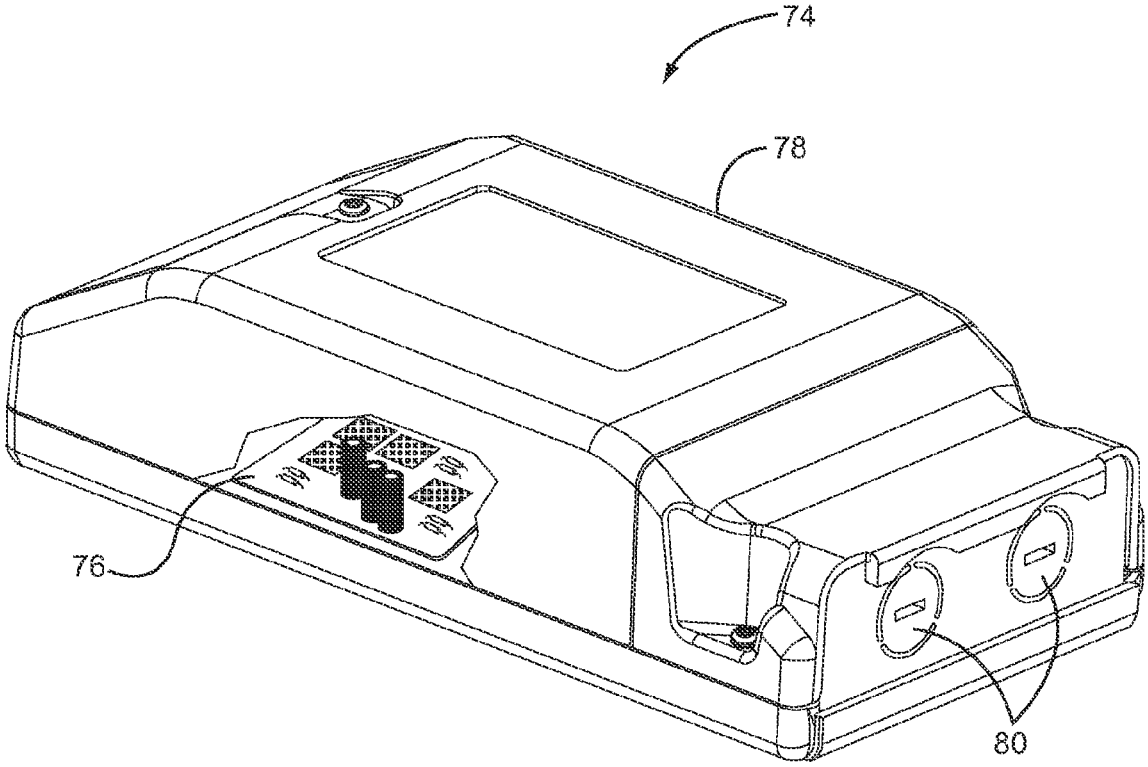
FIG. 14 is an isometric view of a first embodiment of a remote housing.

With reference to FIG. 14, a remote module 74 that may be used in conjunction with the lighting fixture 10 is illustrated. In this embodiment, the remote module 74 provides certain remote electronics 76 that are used to power and control the light source 20. The remote electronics 76 are connected to the light source 20 though a cable (not shown). Access through a housing 78 of the remote module 74 is provided via knock-out plates 80. For example, a knock-out plate 80 may be removed, and the cable may be run through the opening left in the housing 78 by the knock-out plate 80. Strain relief mechanisms may be provided at either ends of the cable.

Figure 15:
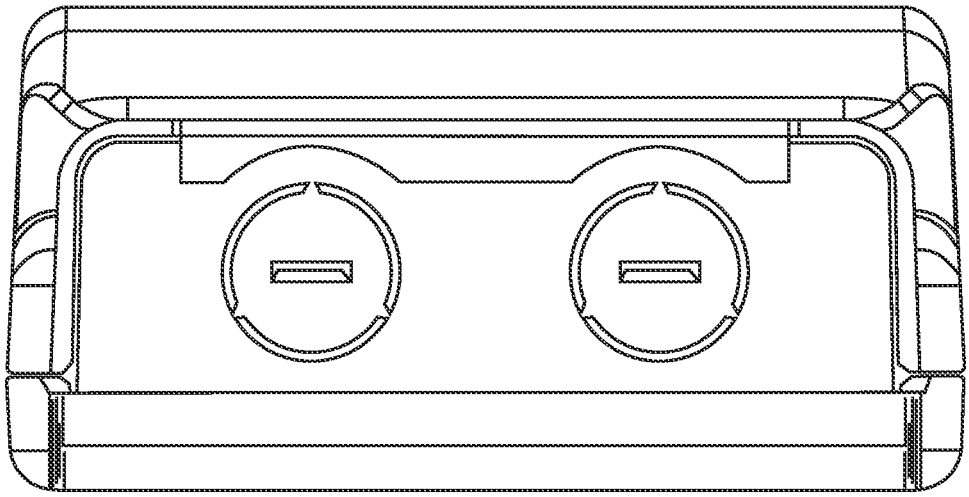
FIG. 15 is a front plan view of the remote housing of FIG. 14.
Figure 16:
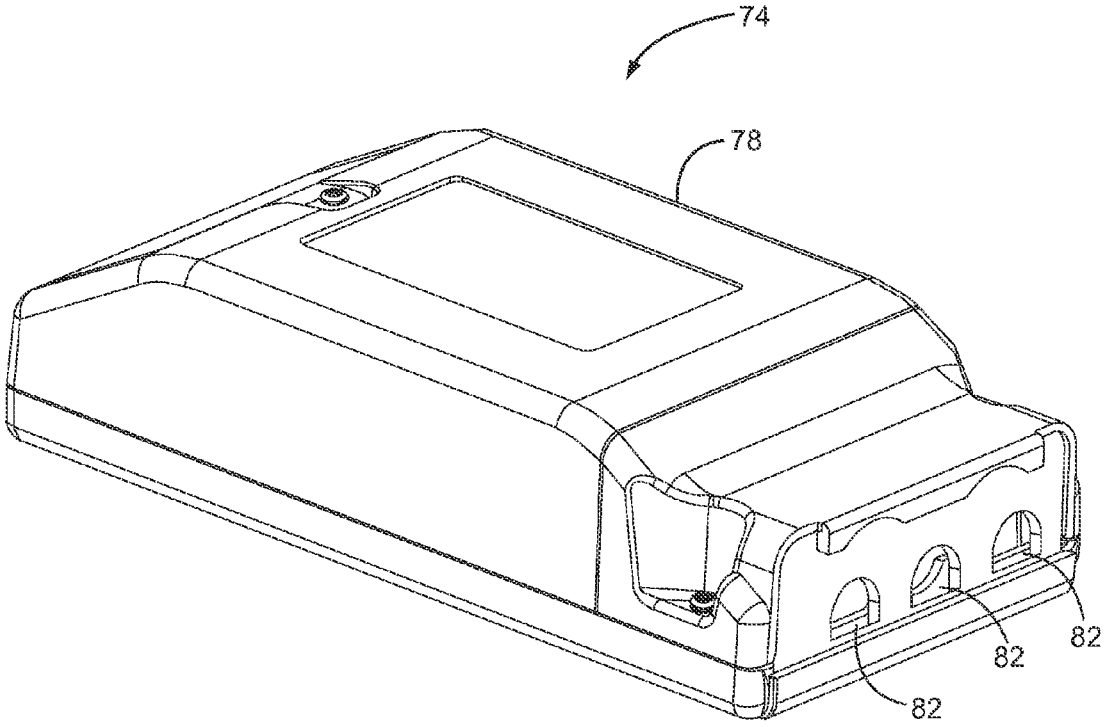
FIG. 16 is an isometric view of a second embodiment of a remote housing.
Figure 17:
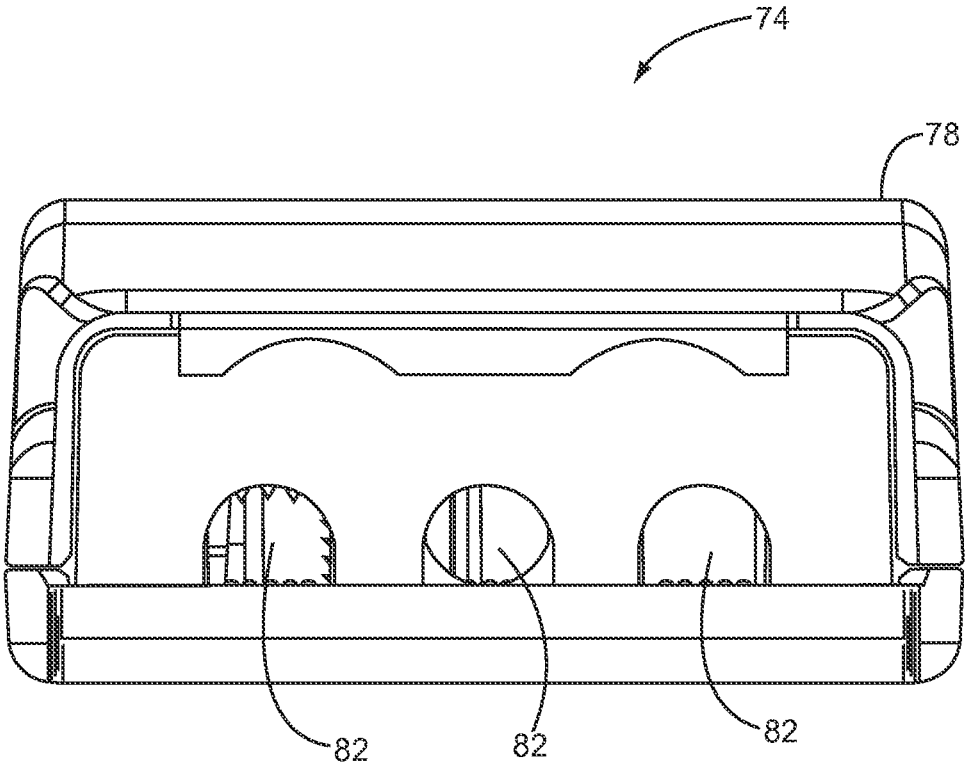
FIG. 17 is a front plan view of the remote housing of FIG. 16.
Figure 18:
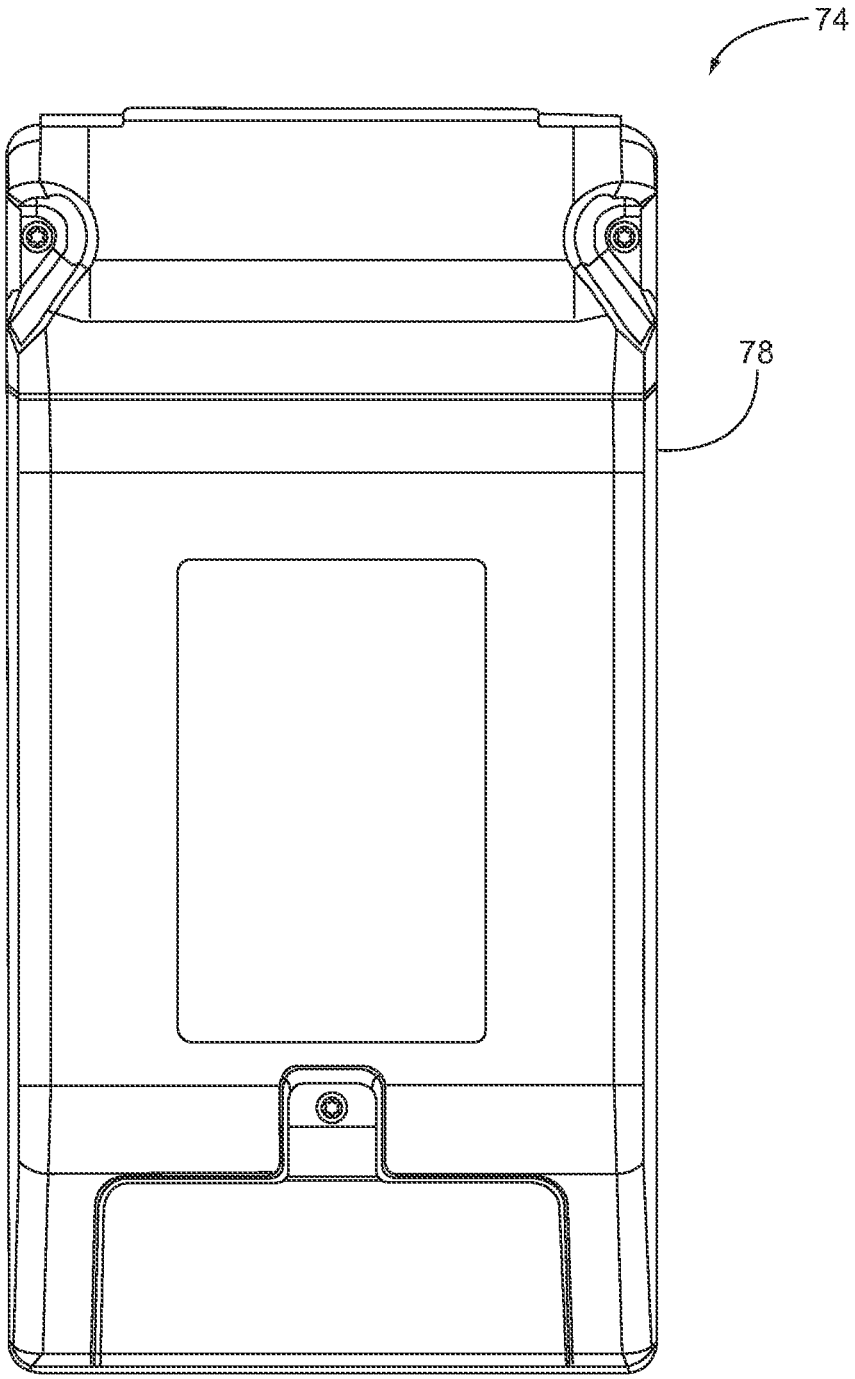
FIG. 18 is a top plan view of the remote housings of FIGS. 14 and 16.
Figure 19:
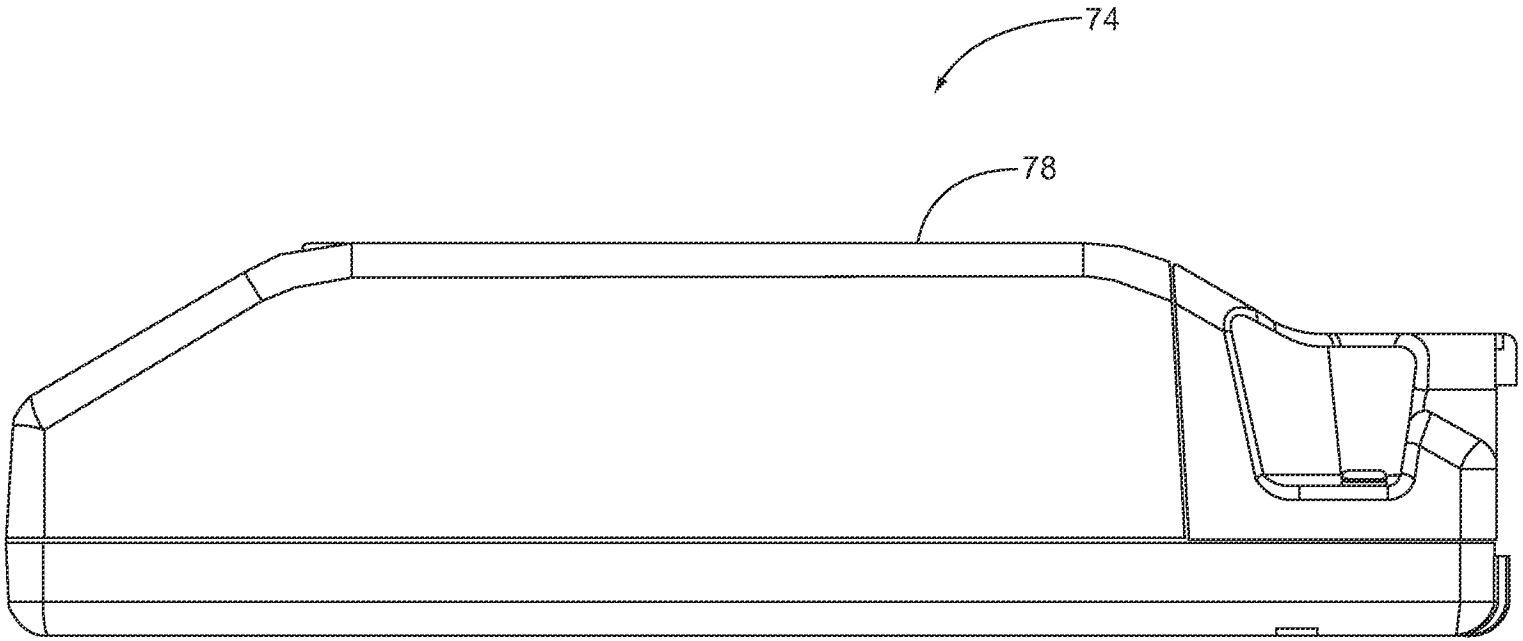
FIG. 19 is a side plan view of the remote housings of FIGS. 14 and 16.
Figure 20:
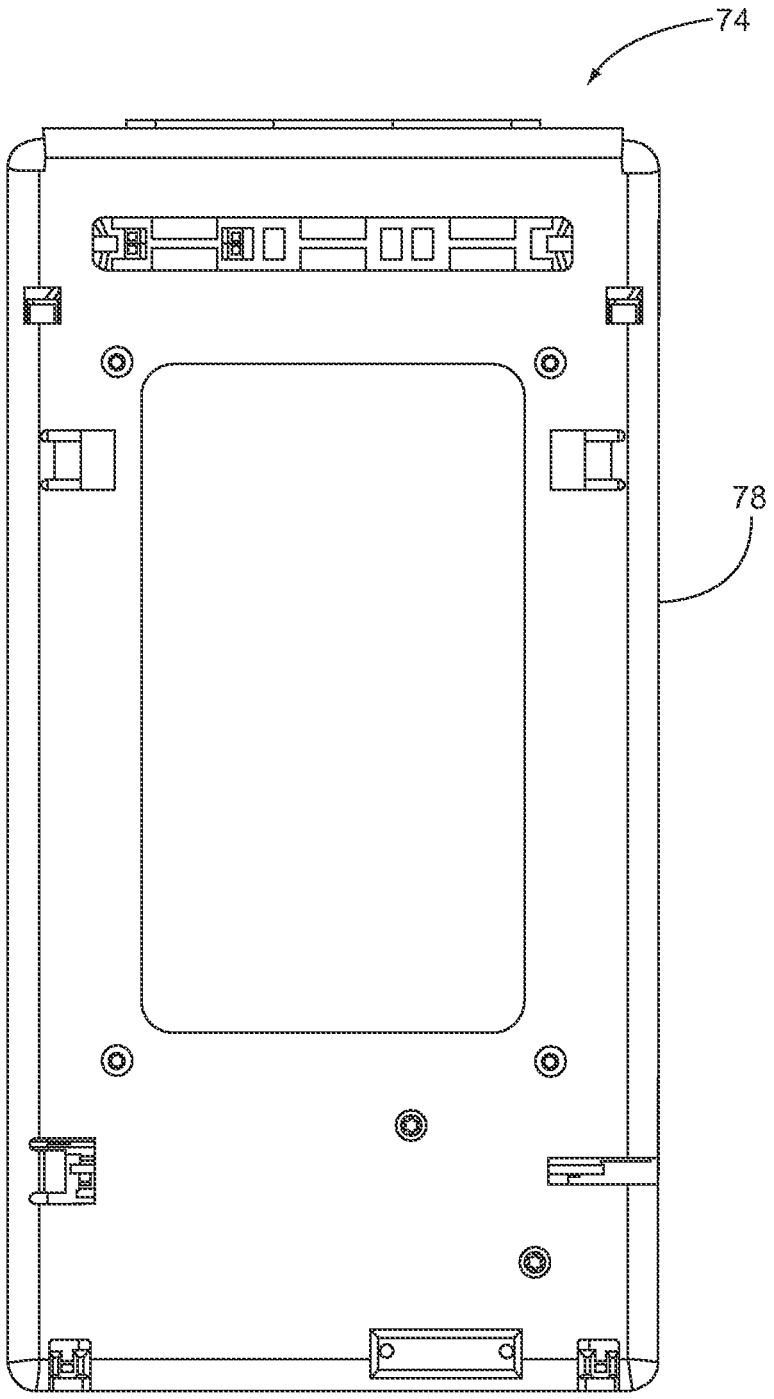
FIG. 20 is a bottom plan view of the remote housings of FIGS. 14 and 16.
Figure 21:
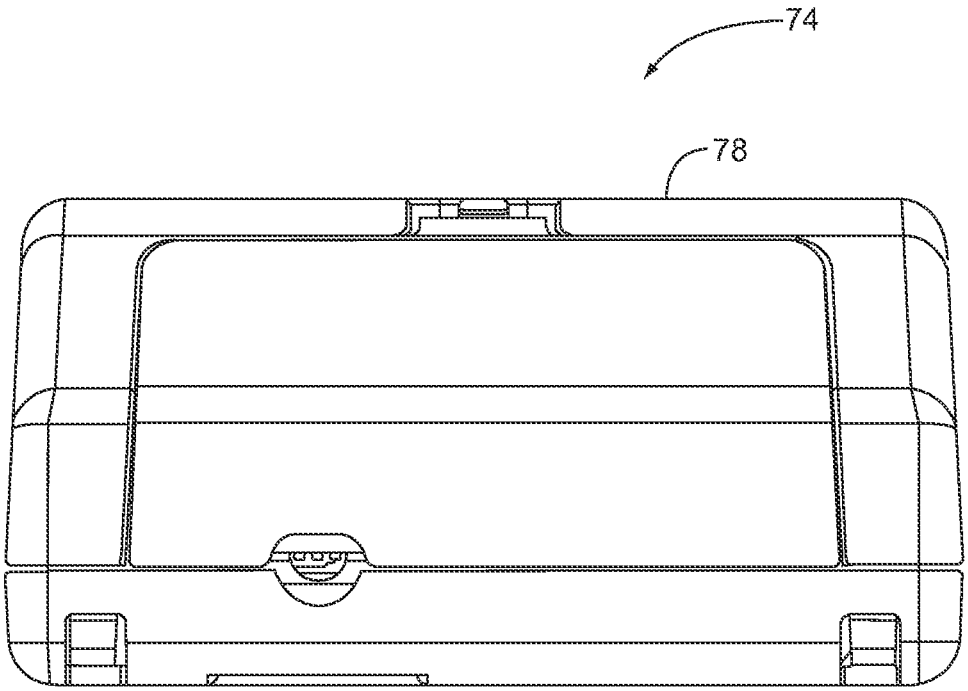
FIG. 21 is a rear plan view of the remote housings of FIGS. 14 and 16.

FIG. 14 illustrates a remote module 74 that provides two knock-out plates 80. A front plan view of the remote module 74 of FIG. 14 is provided in FIG. 15 where the knock-out plates 80 are in place. FIG. 16 illustrates another embodiment of the remote module 74 that provides three knock-out plates 80. A front plan view of the remote module 74 of FIG. 16 is provided in FIG. 17 where the knock-out plates 80 have been removed and corresponding access holes 82 are exposed. FIGS. 18, 19, 20, and 21 illustrate top, side, bottom, and rear plan views of the remote module 74 and its housing 78.

The remote electronics 76 for one embodiment may include both an AC-DC (alternating current-direct current) module and a DC-DC (direct current-direct current) module. The DC-DC module and the light source 20 cooperate such that the DC-DC module generates the requisite drive currents to drive corresponding strands of LEDs provided by the light source 20. The DC-DC module is powered and controlled in part by the AC-DC module.

The AC-DC module is configured to receive an AC power supply signal and an input dimming signal and based on these signals, provide a DC power supply signal and an output dimming signal to the DC-DC module. The AC-DC module includes circuitry to step down and rectify the AC power supply signal to a desired DC voltage, which represents the DC power supply signal. The DC power supply signal is used to power the DC-DC module.

The input dimming signal is an analog or digital control signal that represents a desired level of dimming relative to a maximum desirable lumen output of the light source 20. The input dimming signal may be provided from an appropriate remote control module or lighting switch (not shown), as will be appreciated by those skilled in the art. The AC-DC module provides the necessary circuitry to process the input dimming signal and generate a corresponding output dimming signal based on the desired level of dimming. As will be appreciated by one skilled in the art, the output dimming signal is generally a pulse width modulated (PWM) signal wherein the duty cycle of the output dimming signal is effectively a function of the input dimming signal. Since the input dimming signal corresponds to a desired level of dimming, the duty cycle of the output dimming signal is a function of the desired level of dimming.

In an alternative embodiment, the AC power supply signal may be provided with the use of a dimmer for lighting control. The dimmer may be controlled based on the leading or trailing edge of the AC power supply signal. The portion of the AC waveform received in the AC power supply signal corresponds to the desired level of dimming. As such, the AC-DC module is configured to analyze the AC power supply signal and generate the output signal based thereon.

The DC-DC module generally includes a DC-DC converter and multiple current sources that are supplied by the DC-DC converter. The current sources generate the individual drive currents, which are used to respectively drive different strands of LEDs of the LED module. The DC-DC converter of the DC-DC module is configured to drive the current sources to control the drive currents such that the respective strands of LEDs output light at a desired color as well as a desired intensity based on the output dimming signal. In one embodiment, one or more strands may be formed from red LEDs while one or more of the other strands may be formed from blue-shifted yellow LEDs. The different strands are driven by the drive currents such that the light emitted from the strands mixes to form light at a desired color temperature as well as at a desired intensity based on the desired level of dimming.

The DC-DC module may be configured to provide one or more feedback signals to the AC-DC module. The feedback signals may provide temperature, fault, or other information bearing on the operation of the DC-DC module, and the AC-DC module may be configured to respond to the feedback signals and adjust or control the output dimming signal and the DC power supply signal in a desired manner. Similarly, the LED module may be configured to provide one or more feedback signals to the DC-DC module. The feedback signals may provide temperature, fault, or other information bearing on the operation of the LED module, and the DC-DC module may be configured to respond to the feedback signals and adjust or control the drive currents in a desired manner.

While the disclosed embodiments show the heat sink 14 with the light engine 12, the disclosed heat sink 14 may be used with various light engines other than those disclosed herein. Similarly, the disclosed light engine 12 may be used with various heat sinks other than those disclosed herein.

Those skilled in the art will recognize improvements and modifications to the embodiments of the present disclosure. For example, although the above embodiments are directed to a lighting fixture 10 wherein the light engine 12, heat sink 14, finishing trim 16, and support bracket assembly 18 are substantially cylindrical in nature, any one or all of these components may take on other forms, such as rectangular, triangular, elliptical, and the like. All such improvements and modifications are considered within the scope of the concepts disclosed herein and the claims that follow.

What is claimed is:

1. A lighting apparatus comprising:

a heat sink comprising a forward surface and a central axis that is substantially perpendicular to the forward surface, a first fin section having a plurality of radial fins with a first length and a plurality of radial fins having a second length, the plurality of radial fins being substantially parallel to the central axis and extending radially outward from the central axis, wherein the first length is greater than the second length, and a second fin section with a plurality of radial fins having a third length and being substantially parallel to the central axis and extending radially outward from the central axis, wherein the third length is different from the first length and the second length; and a light engine coupled to the forward surface of the heat sink.

2. The lighting apparatus of claim 1 wherein the heat sink further comprises a central core from which the plurality of first radial fins and the plurality of second radial fins radially extend.

3. The lighting apparatus of claim 2 wherein the central core is solid.

4. The lighting apparatus of claim 3 wherein the central core is substantially cylindrical.

5. The lighting apparatus of claim 1 wherein each of the plurality of radial fins in the first fin section are spaced apart from and adjacent one another and each of the plurality of radial fins in the second fin section are spaced apart from and adjacent one another.

6. The lighting apparatus of claim 1 wherein each of the plurality of radial fins in the first fin section extends to a first periphery of a first radius relative to the central axis and each of the plurality of radial fins in the second fin section extends to a second periphery of a second radius relative to the central axis wherein the second radius is greater than the first radius.

7. The lighting apparatus of claim 1, where each of the plurality of first fin sections alternates with each of the plurality of second fin sections about the central axis of the heat sink.

8. The lighting apparatus of claim 1 wherein the light engine further comprises a retention ring that is mounted above the forward surface of the heat sink and comprises a flange that is substantially parallel to the forward surface of the heat sink and a peripheral sidewall that extends from the flange toward the forward surface of the heat sink.

9. The lighting apparatus of claim 8 wherein the light engine further comprises a light source thermally coupled to the forward surface of the heat sink, a mixing chamber having a forward opening about which the retention ring is mounted and a rear opening receiving the light source.

10. The lighting apparatus of claim 8 wherein the peripheral sidewall terminates with an undulating edge.

11. The lighting apparatus of claim 10 wherein the undulating edge is substantially sinusoidal.

12. The lighting apparatus of claim 10 wherein the undulating edge is characterized as a triangular wave form.

13. The lighting apparatus of claim 10 wherein the undulating edge is characterized as a square wave form.

14. The lighting apparatus of claim 10 wherein the undulating edge is characterized as a sawtooth wave form.

15. The lighting apparatus of claim 10 wherein the peripheral sidewall with the undulating edge forms a plurality of teeth, and openings are provided between the plurality of teeth and the forward surface of the heat sink such that the openings facilitate air flow to inner portions of both the plurality of first fin sections and the plurality of second fin sections.

16. The lighting apparatus of claim 10 wherein the peripheral sidewall is suspended above the plurality of first fin sections and the plurality of second fin sections along the forward surface of the heat sink.

17. The lighting apparatus of claim 10 wherein those portions of the peripheral sidewall closest to the forward surface of the heat sink extend substantially to the forward surface of the heat sink.

18. The lighting apparatus of claim 10 wherein the peripheral sidewall extends about an entirety of the flange.

19. The lighting apparatus of claim 10 wherein the flange of the retention ring is annular and the heat sink is substantially cylindrical about the central axis.

20. The lighting apparatus of claim 10 further comprising a lens that is held in place by the retention ring.

21. The lighting apparatus of claim 1 wherein alternating the plurality of first fin sections and the plurality of second fin sections provides a plurality of recessed portions in an outer periphery of the heat sink and further comprising a support bracket that mounts to a rear surface of the heat sink and comprises a plurality of legs wherein each of the plurality of legs extends parallel to the central axis and along one of the plurality of recessed portions in the outer periphery of the heat sink.

22. The lighting apparatus of claim 21 further comprising a finishing trim coupled to the light engine wherein ends of the plurality of legs are coupled to the finishing trim.

23. The lighting apparatus of claim 1 wherein the light engine comprises light emitting diodes as a light source.

24. The lighting apparatus of claim 1 wherein each of the plurality of radial fins in the second fin section extends to a first periphery of a first radius relative to the central axis and each of the plurality of radial fins in the first fin section extends to a second periphery of a second radius relative to the central axis wherein the second radius is greater than the first radius.

25. A lighting apparatus comprising:

a heat sink with a forward surface; and a light engine comprising a light source thermally coupled to the forward surface and a retention ring that is mounted above the forward surface of the heat sink and comprises a flange that is substantially parallel to the forward surface of the heat sink and a peripheral sidewall that extends from the flange toward the forward surface of the heat sink wherein the peripheral sidewall terminates with an undulating edge.

26. The lighting apparatus of claim 25 wherein the light engine further comprises a mixing chamber having a forward opening about which the retention ring is mounted and a rear opening receiving the light source.

27. The lighting apparatus of claim 25 wherein the undulating edge is substantially sinusoidal.

28. The lighting apparatus of claim 25 wherein the undulating edge is characterized as a triangular wave form.

29. The lighting apparatus of claim 25 wherein the undulating edge is characterized as a square wave form.

30. The lighting apparatus of claim 25 wherein the undulating edge is characterized as a sawtooth wave form.

31. The lighting apparatus of claim 25 wherein the peripheral sidewall with the undulating edge forms a plurality of teeth and openings are provided between the plurality of teeth and the forward surface of the heat sink.

32. The lighting apparatus of claim 25 wherein those portions of the peripheral sidewall closest to the forward surface of the heat sink extend substantially to the forward surface of the heat sink.

33. The lighting apparatus of claim 25 wherein the peripheral sidewall extends about an entirety of the flange.

34. The lighting apparatus of claim 25 wherein the flange of the retention ring is annular and the heat sink is substantially cylindrical.

35. The lighting apparatus of claim 25 further comprising a lens that is held in place by the retention ring.

36. The lighting apparatus of claim 25 wherein the light engine comprises light emitting diodes as a light source.

37. The lighting apparatus of claim 25 wherein the heat sink further comprises a central axis that is substantially perpendicular to the forward surface, a plurality of shorter fin sections with a plurality of shorter radial fins that are substantially parallel to the central axis and extend radially outward from the central axis, and a plurality of longer fin sections with a plurality of longer radial fins that are substantially parallel to the central axis and extend radially outward from the central axis, wherein each of the plurality of shorter fin sections alternates with each of the plurality of longer fin sections about the central axis of the heat sink and the plurality of longer radial fins extend radially outward further than the plurality of shorter radial fins.

38. The lighting apparatus of claim 37 wherein the peripheral sidewall is suspended above the plurality of shorter fin sections and the plurality of longer fin sections along the forward surface of the heat sink.

39. A lighting apparatus comprising a support cup, a light source within the support cup, and a retention ring that is mounted above the support cup and comprises a flange that is substantially parallel to an opening provided by the support cup and a peripheral sidewall that extends from the flange and terminates with an undulating edge.

40. The lighting apparatus of claim 39 wherein the undulating edge is substantially sinusoidal.

41. The lighting apparatus of claim 39 wherein the undulating edge is characterized as a triangular wave form.

42. The lighting apparatus of claim 39 wherein the undulating edge is characterized as a square wave form.

43. The lighting apparatus of claim 39 wherein the undulating edge is characterized as a sawtooth wave form.

44. The lighting apparatus of claim 39 wherein the light source comprises light emitting diodes.

45. A heat sink having a central axis and comprising:

a first fin section having:

a plurality of radial fins with a first length; and a plurality of radial fins with a second length, the plurality of radial fins being substantially parallel to the central axis and extending radially outward from the central axis, wherein the first length is greater than the second length; and a second fin section with a plurality of radial fins having a third length and being substantially parallel to the central axis and extending radially outward from the central axis, wherein the third length is different from the first length and the second length.

46. A heat sink having a central axis and comprising:

a first fin section having at least two first radial fins that are substantially parallel to the central axis and extend radially outward from the central axis;

an second fin section with at least two second radial fins that are substantially parallel to the central axis and extend radially outward from the central axis, wherein the at least two second radial fins extend radially outward further than the plurality of first radial fins; and a third fin section having at least two third radial fins that are substantially parallel to the central axis and extend radially outward from the central axis, wherein the at least two third radial fins extend radially outward further than the plurality of second radial fins.

47. The heat sink of claim 46 further comprising a central core from which the first section, the second fin section, and the third fin section radially extend.

48. The heat sink of claim 46 wherein the at least two first radial fins are spaced apart from and adjacent one another, the at least two second radial fins are spaced apart from and adjacent one another, and the at least two third radial fins are spaced apart from and adjacent one another.

49. The heat sink of claim 46 wherein the at least two first radial fins extend to a first periphery of a first radius relative to the central axis, the at least two second radial fins extend to the first periphery of the first radius, and the at least third radial fins extend to a second periphery of a second radius relative to the central axis wherein the second radius is greater than the first radius.

50. The heat sink of claim 46 wherein the at least two first radial fins extend to a first periphery of a first radius relative to the central axis, the at least two second radial fins extend to a second periphery of a second radius relative to the central axis, and the at least third radial fins extend to the second periphery of the second radius relative to the central axis wherein the second radius is greater than the first radius.

* * * * *